US011484158B2

(12) United States Patent
Chung

(10) Patent No.: US 11,484,158 B2
(45) Date of Patent: Nov. 1, 2022

(54) SHOWER PANEL WITH INFRARED HEATING ELEMENT

(71) Applicant: Kohler Co., Kohler, WI (US)

(72) Inventor: Chanseol Chung, Milwaukee, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 17/167,796

(22) Filed: Feb. 4, 2021

(65) Prior Publication Data

US 2021/0153697 A1 May 27, 2021

Related U.S. Application Data

(63) Continuation of application No. PCT/US2019/045995, filed on Aug. 9, 2019.

(60) Provisional application No. 62/717,288, filed on Aug. 10, 2018.

(51) Int. Cl.
*A47K 3/28* (2006.01)
*H05B 3/00* (2006.01)

(52) U.S. Cl.
CPC ..... *A47K 3/281* (2013.01); *H05B 3/008* (2013.01)

(58) Field of Classification Search
USPC ..... 4/580, 525; 239/511
See application file for complete search history.

(56) References Cited

U.S. PATENT DOCUMENTS 530,464 A 12/1894 Van Dyke
622,132 A 3/1899 Dungan
1,434,757 A 11/1922 Thomas
1,492,750 A 5/1924 Rogers et al.
1,504,000 A 8/1924 Simmons
1,895,307 A 1/1933 Beck
2,527,852 A 10/1950 Rinehimer
2,539,976 A 1/1951 Samson et al.
2,601,655 A 6/1952 Young
2,900,139 A 8/1959 Hensley, Jr.
2,915,252 A 12/1959 Umbricht et al.
2,994,484 A 8/1961 Stearns
3,133,292 A * 5/1964 Spier ..... A47K 3/002 4/580
3,465,968 A 9/1969 Halpern
3,847,159 A 11/1974 Hofer
4,071,193 A 1/1978 Sterndy et al.
4,700,893 A 10/1987 Bugler, III
(Continued)

FOREIGN PATENT DOCUMENTS

CN 107510594 12/2017
CN 206687896 12/2017
(Continued)

OTHER PUBLICATIONS

Foreign Search Report on PCT PCT/US2019/045995 dated Nov. 13, 2019.

*Primary Examiner* — Lauren A Crane
(74) *Attorney, Agent, or Firm* — Foley & Lardner LLP

(57) ABSTRACT

A shower panel includes an infrared heater and a panel assembly. The panel assembly includes a deflection surface. The infrared heater, located near the panel assembly, produces infrared rays in the shower cell. The infrared rays heat the general space of the shower cell. The deflection surface includes a profile that contains various deflection features that deflect the stream of water toward the user in the shower cell.

18 Claims, 18 Drawing Sheets

(56) References Cited

U.S. PATENT DOCUMENTS

| | | | | |
|---|---|---|---|---|
| 4,912,782 | A | 4/1990 | Roddins | |
| 4,914,770 | A | 4/1990 | Baus | |
| 4,993,201 | A | 2/1991 | Bunyard | |
| 5,137,214 | A | 8/1992 | Mallery | |
| 5,142,713 | A * | 9/1992 | Makool | A61H 33/10 4/525 |
| 5,224,652 | A | 7/1993 | Kessler | |
| 5,255,399 | A | 10/1993 | Park | |
| 5,544,369 | A | 8/1996 | Roderts | |
| 5,642,959 | A | 7/1997 | Greferath | |
| 5,671,488 | A | 9/1997 | Greferath | |
| 5,974,604 | A | 11/1999 | Barnea | |
| 5,987,662 | A | 11/1999 | Kiyokawa et al. | |
| 6,119,965 | A | 9/2000 | Chang | |
| 6,895,609 | B2 | 5/2005 | Ingram et al. | |
| 7,073,214 | B2 | 7/2006 | Pastorelli | |
| 7,287,287 | B2 | 10/2007 | Wegdam et al. | |
| 7,503,926 | B2 | 3/2009 | Daffer et al. | |
| 7,611,072 | B2 | 11/2009 | Peters et al. | |
| 9,161,882 | B2 | 10/2015 | Faridoon | |
| 2006/0207012 | A1 | 9/2006 | DeBoer et al. | |
| 2008/0292293 | A1 | 11/2008 | Song | |
| 2009/0173388 | A1 | 7/2009 | Sever | |
| 2013/0014322 | A1 * | 1/2013 | Zada | A47K 7/046 4/606 |
| 2016/0367082 | A1 | 12/2016 | Whitaker | |
| 2017/0080437 | A1 | 3/2017 | Brewer | |
| 2017/0189919 | A1 | 7/2017 | Mei | |

FOREIGN PATENT DOCUMENTS

| | | |
|---|---|---|
| CN | 207055414 | 3/2018 |
| DE | 20 2016 105 011 | 12/2017 |
| EP | 2 353 478 | 8/2011 |
| JP | 5827917 | 10/2013 |

* cited by examiner

SHOWER PANEL WITH INFRARED HEATING ELEMENT

CROSS REFERENCE TO RELATED APPLICATIONS

The present application is a Continuation of International Patent Application No. PCT/US2019/045995, filed on Aug. 9, 2019, which claims priority to U.S. Provisional Patent Application 62/717,288, filed on Aug. 10, 2018, both of which are hereby incorporated by reference in their entirety.

BACKGROUND

The present application relates generally to a shower panel. Further, this application relates to a shower panel that includes an infrared heating element and a panel with a deflection surface.

Infrared (IR) heating technology is being related to a multitude of health benefits, such as reducing pain from injuries, a boost in metabolism, and an increase in blood circulation. In order to reap the health benefits of IR technology, there are commercial facilities and residents who wish to install IR saunas. However, there can be a limited amount of space for this undertaking, which can also be significantly expensive. Thus, an infrared heater that serves various purposes may be beneficial.

SUMMARY

One implementation of the present disclosure is related to a shower panel. The shower panel includes an infrared heater and a panel assembly. The panel assembly is located in an upper portion of a shower cell. The panel assembly includes a deflection surface. The infrared heater, located inside the panel assembly and above the deflection surface, produces infrared rays in the shower cell. The infrared rays heat the general space of the shower cell. The deflection surface includes an irregular profile that contains various features that deflect the upward spray of water to fall down onto the user in the shower cell.

Another implementation of the present disclosure is related to a shower panel. The shower panel includes a body, a panel, and a deflection surface. The body may be coupled to a surface within a shower cell. The panel is coupled to the body opposite the surface. The deflection surface is disposed on the panel opposite the body. The deflection surface is configured to accept a spray of water from a shower head. The deflection surface may be concave. The deflection surface may include a plurality of deflection features, where the deflection features are configured to accept the spray of water and reflect the spray of water toward a target. The deflection surface may include a leading edge that is positioned to face in the general direction of the shower head and a trailing edge that is positioned to face in the direction generally away from the shower head. The plurality of deflection features may be more concentrated nearer the leading edge than nearer the trailing edge. The panel assembly may also include an infrared heater disposed proximate the deflection surface. The infrared heater by be disposed behind the deflection surface and within the panel. The infrared heater may be configured to heat a space within the shower cell and heat the deflection surface.

It is to be understood that both the foregoing general description and the following detailed description are exemplary and explanatory only and are not restrictive of the invention as claimed.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Many IR saunas utilize an IR heater that is incapable of being installed in a user's bathroom or desired sauna space due to size restrictions or other limitations. These IR heaters can also be costly to purchase and install for a commercial facility or a resident looking to gain the benefits from IR heating technology. Because of these limitations, employing an IR heater that has multiple functions and that also occupies unused space (i.e., at the top of a shower cell) can provide users with an alternative option for capturing the benefits of IR heating technology. An IR heater in a shower panel can warm the space of a shower cell, creating a sauna-like effect for the user. Furthermore, a deflection surface on the panel can redirect the water to fall down onto the user, in a manner similar to how rain falls. This can result in a refreshing "rainfall effect" experience for the user while showering. By combining both the deflection surface of the panel with the IR heating technology, this disclosure may provide the benefits from IR exposure, an experience similar to being in a sauna, and a soothing effect in the shower of water falling like rain.

Various embodiments described herein are directed to a shower that can provide warm water at an angle or straight down onto to a user in a heated shower environment by incorporating a panel assembly within the shower and an infrared heater. Such a shower would have additional capability compared to other showers and may provide a user with increased satisfaction when using the shower. However, in other embodiments the shower described herein may not include an infrared heater and may still provide the "rainfall effect" using the deflection surface without an infrared heater.

Figure 1:
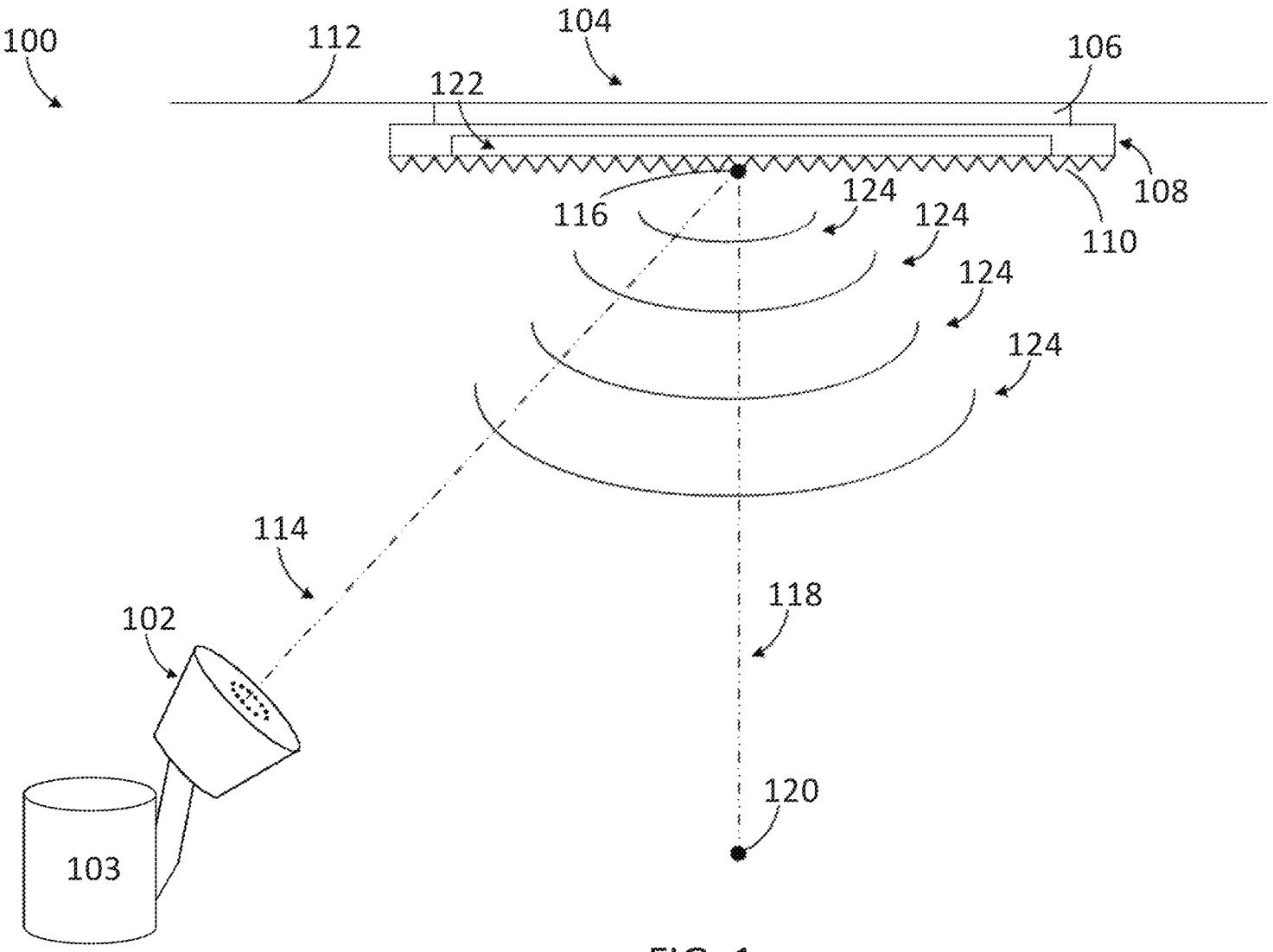
FIG. 1 is a front view of a shower system with an infrared heater and panel assembly, according to an exemplary embodiment of the present disclosure.

Referring to FIG. 1, a shower system (e.g., shower assembly, flexible shower assembly, etc.), shown as a shower system 100, is shown. The shower system 100 is utilized by a user (e.g., shower user, individual, homeowner, etc.) to selectively spray (e.g., dispense, eject, propel, etc.) water (e.g., softened water, fluid, etc.). For example, the shower system 100 may be utilized by a user to spray water onto the user or an object (e.g., item to be cleaned, etc.). In this way, the user may utilize the shower system 100 to cleanse the user's body (e.g., hair, etc.).

In an exemplary embodiment, shower system 100 includes a first assembly (e.g., system, head assembly, sprayer assembly, etc.), shown as a shower head assembly 102, a second assembly (e.g., system, rain panel assembly, spray panel assembly, overhead assembly, etc.), shown as a panel assembly 104, and an infrared (IR) heater (e.g., an IR sauna lamp, an IR bathroom heater, etc.), shown as IR heater 122. The shower head assembly 102 receives water from a water supply and selectively provides the water from the water supply. For example, the shower head assembly 102 is selectively controllable to provide a desired amount of water from the shower head assembly 102. The shower head assembly 102 includes one or more controls (e.g., handles, knobs, levers, slides, touch screen controls, smart controls, etc.) that control how much water is provided from the shower head assembly 102 and the temperature of the water provided from the shower head assembly 102. In some embodiments, the shower head assembly includes an actuator (e.g., motor, servo, etc.), shown as an actuator 103. The actuator 103 may be selectively controlled by the user to direct the shower head assembly in a desired direction. The shower head assembly 102 generally disperses the water along a trajectory (e.g., path, line, etc.), shown as a trajectory 114, towards a target (e.g., focal point, aim point, etc.), shown as a target 116.

According to one embodiment, the shower head assembly 102 may be a shower head such as disclosed in U.S. Provisional Patent Application 62/729,464, the complete disclosure of which is hereby incorporated by reference in its entirety.

The panel assembly 104 includes a body (e.g., frame, base, etc.), shown as a body 106, and a panel (e.g., glass panel, textured panel, splash panel, etc.), shown as panel 108. The panel assembly 104 may be located in an upper portion (e.g., near the ceiling) of a shower cell, with the IR heater 122 disposed within the panel 108. The body 106 may be coupled (e.g., attached, fastened, adhered, etc.) to a surface (e.g., wall, etc.), shown as a ceiling 112. For example, the body 106 may be attached to the ceiling 112 in a retrofit application. The panel 108 may also be affixed overhead in the upper portion of a shower cell instead of being attached to the ceiling 112. When water contacts the panel 108, the water is deflected or redirected. In this way, the shower system 100 utilizes the panel assembly 104 to cause water to drop (e.g., fall, etc.) onto the user. This effect may, for example, simulate a "rain" (e.g., rain-drop, rain fall, etc.) experience.

Figure 2:
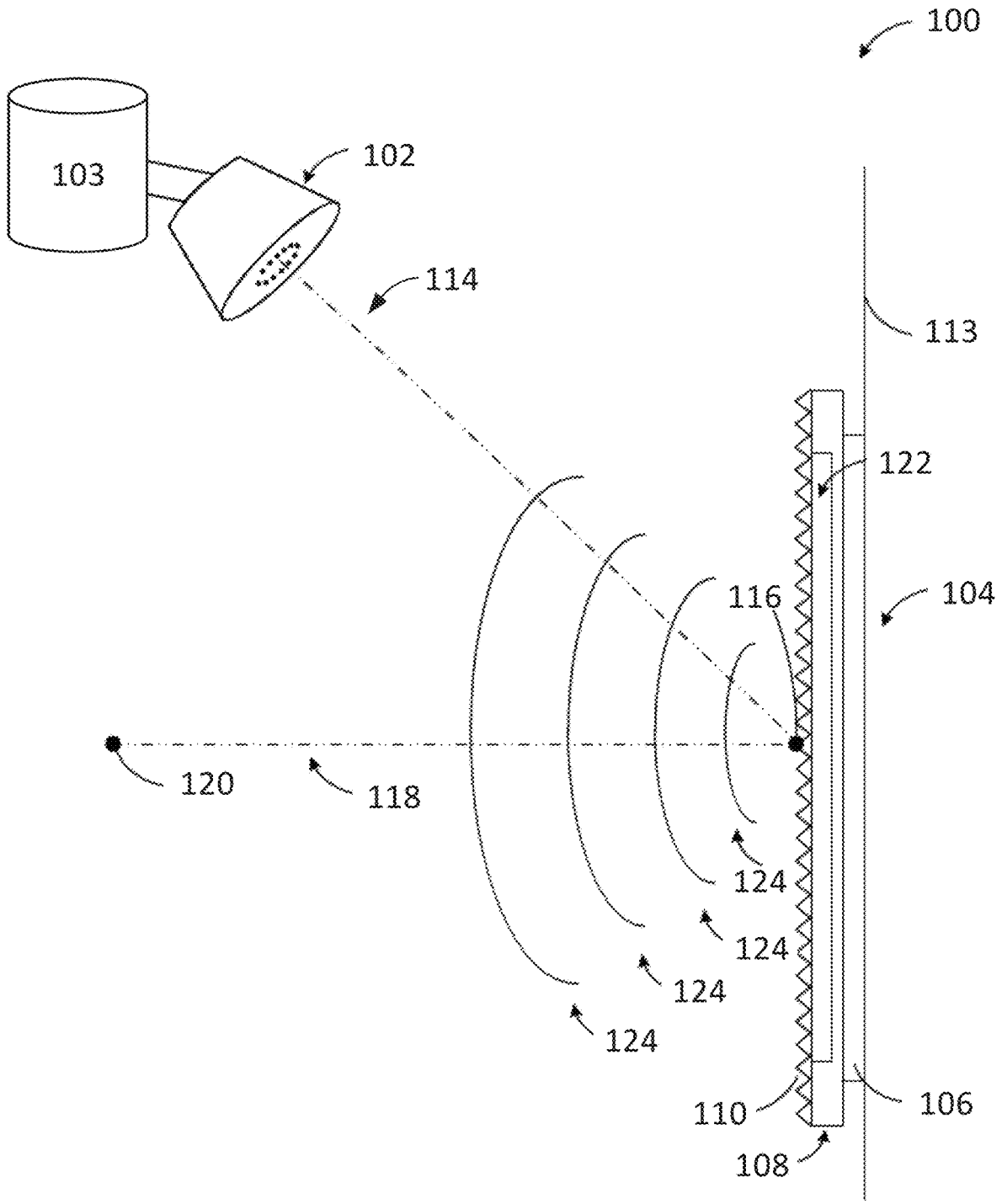
FIG. 2 is a front view of a shower system with an infrared heater and panel assembly, according to an exemplary embodiment of the present disclosure.

Referring to FIG. 2, the panel assembly 104 may be located at side portions (e.g., on a wall, in front of a wall, etc.) of a shower cell with the IR heater 122 disposed within the panel 108. The body 106 may be coupled (e.g., attached, fastened, adhered, etc.) to a surface (e.g., wall, etc.), shown as a wall 113. For example, the body 106 may be attached to the wall 113 in a retrofit application. The panel may also be affixed proximate the side portions of the shower cell instead of being coupled to the wall 113. When water contacts the panel 108, the water is deflected or redirected. In this way, the shower system 100 utilizes the panel assembly 104 to cause water to spray (e.g., shoot, mist, squirt, etc.) onto the user. This effect may, for example, simulate the experience of a wall-mounted shower nozzle.

The panel 108 includes a surface (e.g., face, etc.), shown as a deflection surface 110. The IR heater 122 is disposed behind the deflection surface 110. The target 116 of the trajectory of water is positioned on the deflection surface 110 to cause the water to fall in a shower pattern onto the user. Likewise, the target 116 may be positioned on the deflection surface 110 coupled to the wall 113 such that the deflection surface 110 causes the water to spray on the user from the side. The deflection surface 110 may include a plurality of features that are configured to provide various effects on the water propelled from the shower head assembly 102. In an exemplary embodiment, the deflection surface 110 is concave in shape. Depending on where the target 116 is located along the deflection surface 110, the water may fall or spray onto the user differently or may fall or spray onto the user in different locations. Similar to the shower head assembly 102, the deflection surface 110 causes the water to fall along a trajectory (e.g., path, center line, axis, etc.), shown as a trajectory 118, towards a target (e.g., focal point, aim point, etc.), shown as a secondary target 120 (e.g., a final target, a spray target, etc.).

Figure 3:
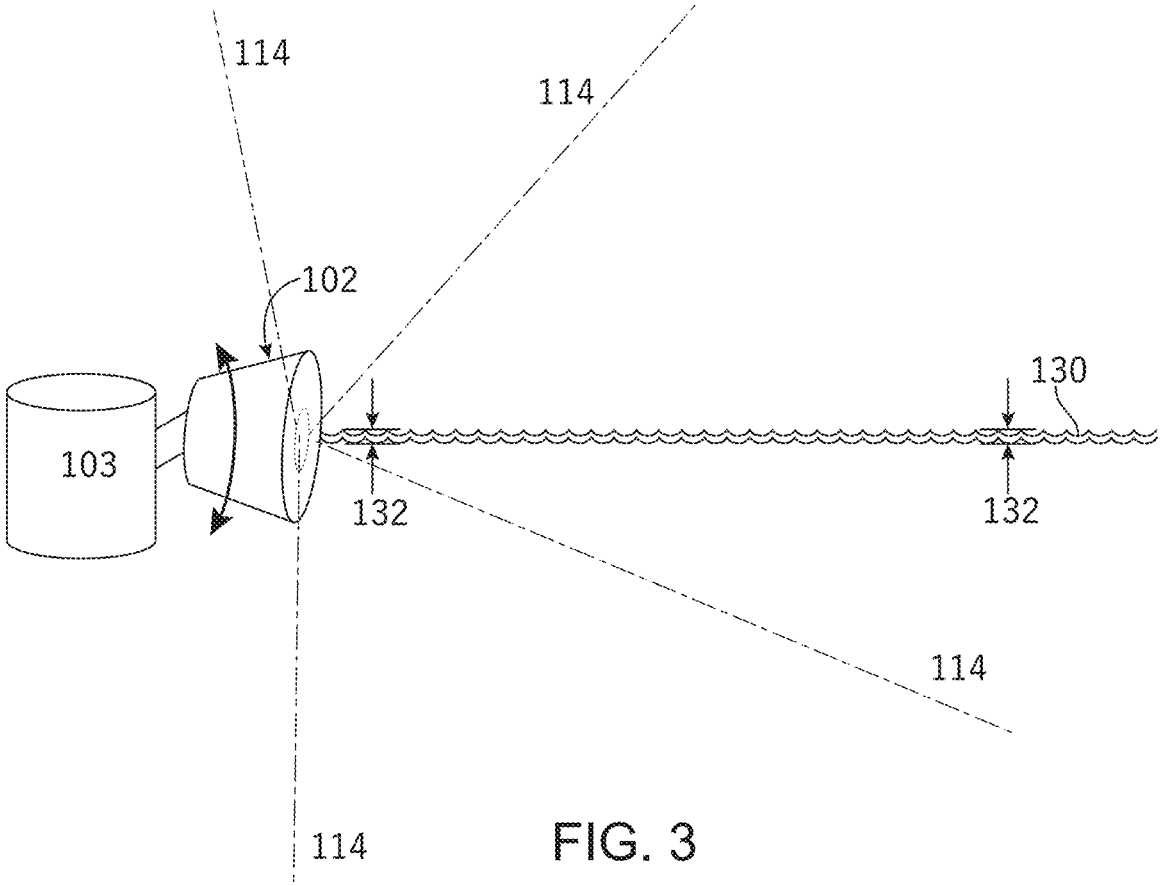
FIG. 3 is a side view of a shower head assembly, according to an exemplary embodiment of the present disclosure.

Referring to FIG. 3, the shower head assembly 102 is configured to provide the water in a narrow, high-pressure stream (e.g., jet, spray, etc.), shown as a narrow stream 130. The narrow stream 130 may be laminar or turbulent. The narrow stream 130 has a diameter as it exits the shower head assembly 102, shown as a diameter 132. The narrow stream 130 is configured to still have generally the diameter 132 a distance from the shower head assembly 102. As will be explained in further detail herein, and appreciated by those skilled in the art, the narrow stream 130 improves the utility of deflection features proximate the sides of a shower cell. The narrow stream 130 comes into contact with the deflection features and reflects as a spray. While the narrow stream 130 itself may not be comfortable to a user using the shower head assembly 102, the reflection of the narrow stream 130 off the deflection features provides the user with a more comfortable and unique shower experience.

The shower head assembly 102 also includes the actuator 103. The actuator 103 is configured to direct the shower head assembly 102 in a desirable direction. In some embodiments, the actuator 103 has 3-axis control such that the shower head assembly 102 can be pointed in any direction in three-dimensional space. In some embodiments, the actuator 103 is configured to be controlled by a processor such that the shower head assembly 102 is pointed in various directions based on user preferences. For example, if the user prefers the water to spray from above, the user may tell the processor, by means of a user input, to point the shower head assembly 102 at a ceiling or other surface above the user. In another example, perhaps the user prefers the water to spray from the sides. Again, the user may input, to a user interface, that they prefer water to spray from the side. Thus, the actuator 103 would face the shower head assembly 102 toward the panel assembly 104 on the wall 113 such that the narrow stream 130 hits the deflection surface 110 and sprays at the secondary target 120, such as onto the user. The trajectory 114 is an example trajectory for the actuator 103 to direct the shower head assembly 102 such that the narrow stream 130 follows the trajectory 114. The trajectory 114 demonstrates an example path for the narrow stream 130 to follow and is not meant to be limiting. In some embodiments, the actuator 103 is manually operative such that a user can change the direction of the shower head assembly 102 by hand instead of through the processor.

In some embodiments, the shower head assembly 102 may include a digital diverter. The digital diverter may be controllable by the processor such that the digital diverter can selectively prevent a flow of water from exiting the shower head assembly 102. In some embodiments, the shower head assembly 102 includes a solenoid valve controlled by the processor to selectively prevent a flow of water from exiting the shower head assembly 102.

Figure 4:
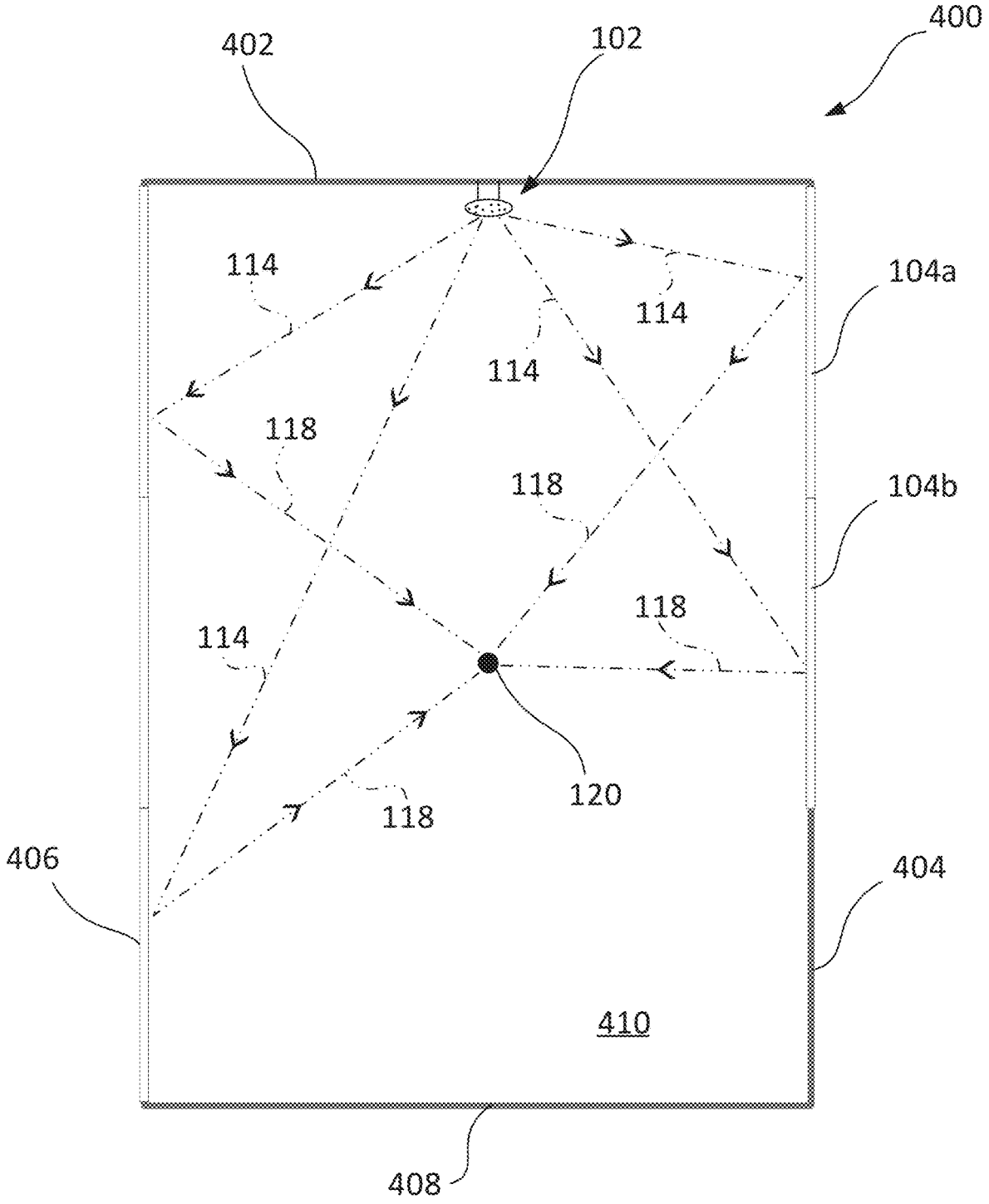
FIG. 4 is a top-down view of a shower cell with an infrared heater and panel assembly, according to an exemplary embodiment of the present disclosure.

Referring to FIG. 4, more than one panel assembly 104 may cooperate to create a cell (e.g., shower cell, room, shower room, shower, etc.), shown as a shower cell 400. Referring to FIG. 4, the shower cell 400 from the top, looking down. The shower cell 400 is defined by six surfaces, shown as a front wall 402, a right wall 404, a left wall 406, a back wall 408, a floor 410, and the ceiling 112 (herein referred to as "the walls"). In some embodiments, the walls that define the shower cell 400 are curved. In some embodiments, each of the walls includes the panel assembly 104. In some embodiments, at least one of the walls includes more than one panel assembly 104. Disposed within the shower cell 400, proximate the front wall 402, is the shower head assembly 102. In some embodiments, the shower head assembly 102 is disposed at a center point of the front wall 402. In some embodiments, the shower head assembly 102 is disposed nearer to the right wall 404 than to the left wall 406, and vice versa. In some embodiments, the shower head assembly 102 is disposed nearer to the ceiling 112 than to the floor 410, and vice versa. In some embodiments, more than one shower head assembly 102 is disposed within the shower cell 400 and configured to spray the narrow stream 130 at the panel assembly 104 disposed on one of the front wall 402, the right wall 404, the left wall 406, the back wall 408, and the floor 410.

The secondary target 120 may be disposed within the shower cell 400, preferably at a midpoint of the front wall 402 and separated a distance from the front wall 402. The right wall 404 may include more than one panel assembly 104, each configured to accept the trajectory 114 of water and reflect the trajectory 118 of water at an angle different from another panel assembly 104. For example, the right wall 404 of the shower cell 400 includes a first panel assembly 104*a* and a second panel assembly 104*b*. The first panel assembly 104*a* is configured to accept the trajectory 114 and reflect the trajectory 118 at a first angle such that the trajectory 118 reaches the secondary target 120. The second panel assembly 104*b* is configured to accept the trajectory 114 and reflect the water at the trajectory 118 at a second angle such that the trajectory 118 reaches the secondary target 120. The first angle may be different from the second angle. In some embodiments, the shower head assembly 102 is configured to alternate between spraying the first panel assembly 104*a* and spraying the second panel assembly 104*b*. In some embodiments, the first panel assembly 104*a* and the second panel assembly 104*b* are manufactured from a single, contiguous body, thus combined and effectively a single panel configured to reflect the trajectory 118 to the secondary target 120.

In some embodiments, the shower cell 400 has a first shower head assembly and a second shower head assembly disposed proximate the front wall 402. The first shower head assembly is configured to spray the narrow stream 130 at the first panel assembly 104*a*, and the second shower head assembly is configured to spray the narrow stream 130 at the second panel assembly 104*b*. The first shower head assembly 102*a* and the second shower head assembly 102*b* may be controlled by a digital diverter such that the first shower head assembly sprays the narrow stream 130 while the second shower head assembly prevents the flow of water, and vice versa.

In some embodiments, the right wall 404 and the ceiling 112 cooperate to reflect the trajectory 118 such that the secondary target 120 is sprayed with water from above and from the side. In some embodiments, the floor 410 includes the panel assembly 104, configured to reflect the trajectory 118 at the secondary target from below. The floor 410 may cooperate with the right wall 404 and the ceiling 112 to reflect the trajectory 118 toward the secondary target 120 from above, below, and from the side.

FIGS. 5A-5D illustrate the panel assembly 104 in greater detail according to various embodiments. The deflection surface 110 includes a plurality of features (e.g., protrusions, protuberances, projections, ribs, bumps, divots, cut-outs, etc.), shown as deflection features 500. The deflection features 500 are configured to deflect water from the shower head assembly 102 towards the secondary target 120 (e.g., generally along the trajectory 118, etc.). The deflection features 500 are oriented with respect to an edge (e.g., face, side, etc.) of the deflection surface 110, shown as a leading edge 502, which is oriented generally toward the shower head assembly 102. Various shapes, sizes, and configurations of the deflection features 500 are included on the deflection surface 110. Different deflection features 500 cause water to be deflected in different ways (e.g., forming different sized droplets of water, etc.). By altering the shapes, sizes, and configuration of the deflection features 500, the "rain" or spray experienced by the user can be varied. While various examples of the deflection features 500 are shown and described herein, it is understood that various other shapes, sizes, and configurations of the deflection features 500 are similarly possible.

Figure 5A:
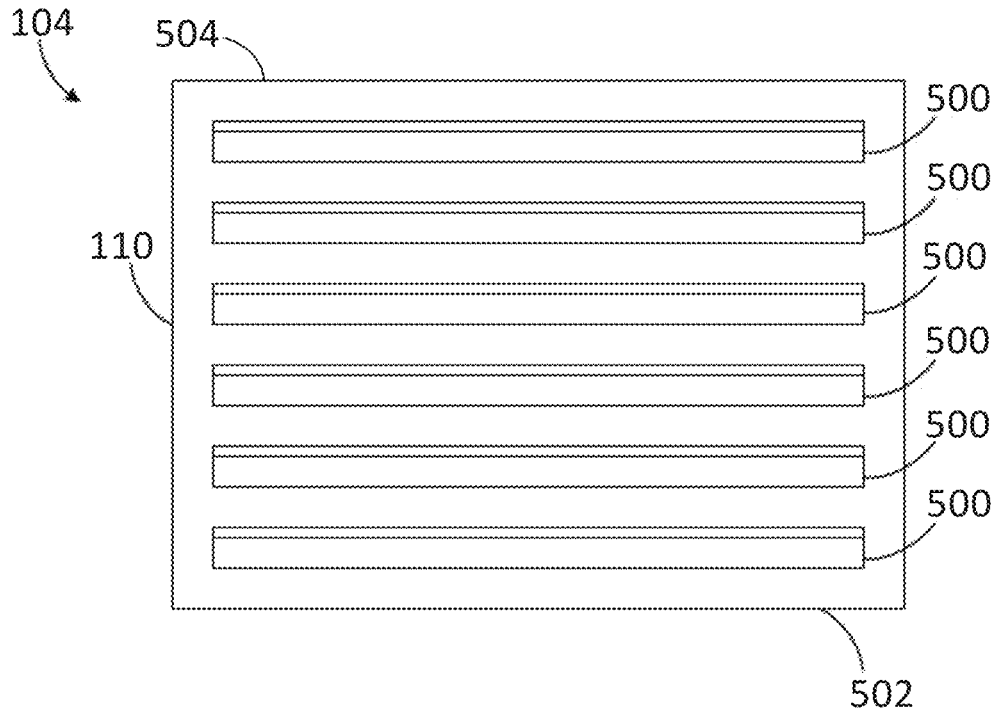
FIG. 5A is a bottom view of a panel assembly for use in a shower system, such as the shower system shown in FIG. 1, according to an exemplary embodiment of the present disclosure.
Figure 5B:
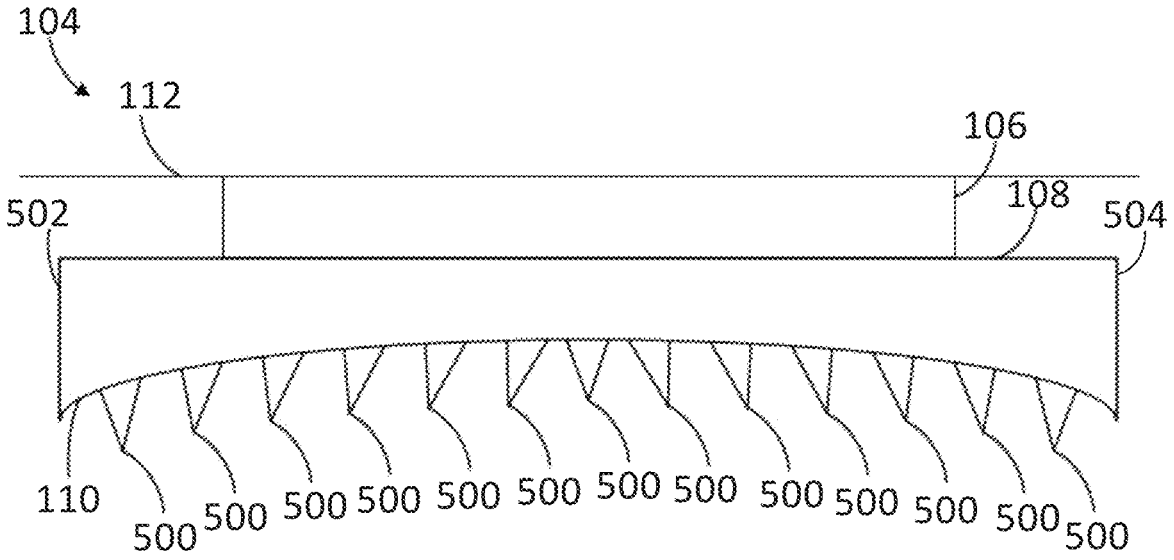
FIG. 5B is a side view of a panel assembly for use in a shower system, such as the shower system shown in FIG. 1, according to an exemplary embodiment of the present disclosure.
Figure 5C:
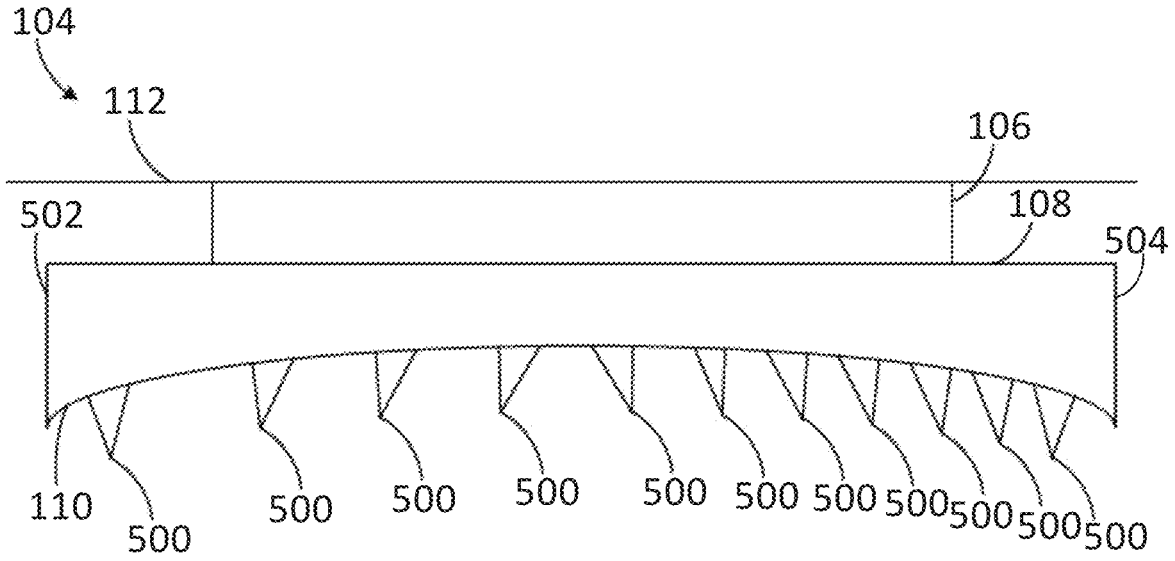
FIG. 5C is another side view of a panel assembly for use in a shower system, such as the shower system shown in FIG. 1, according to an exemplary embodiment of the present disclosure.
Figure 5D:
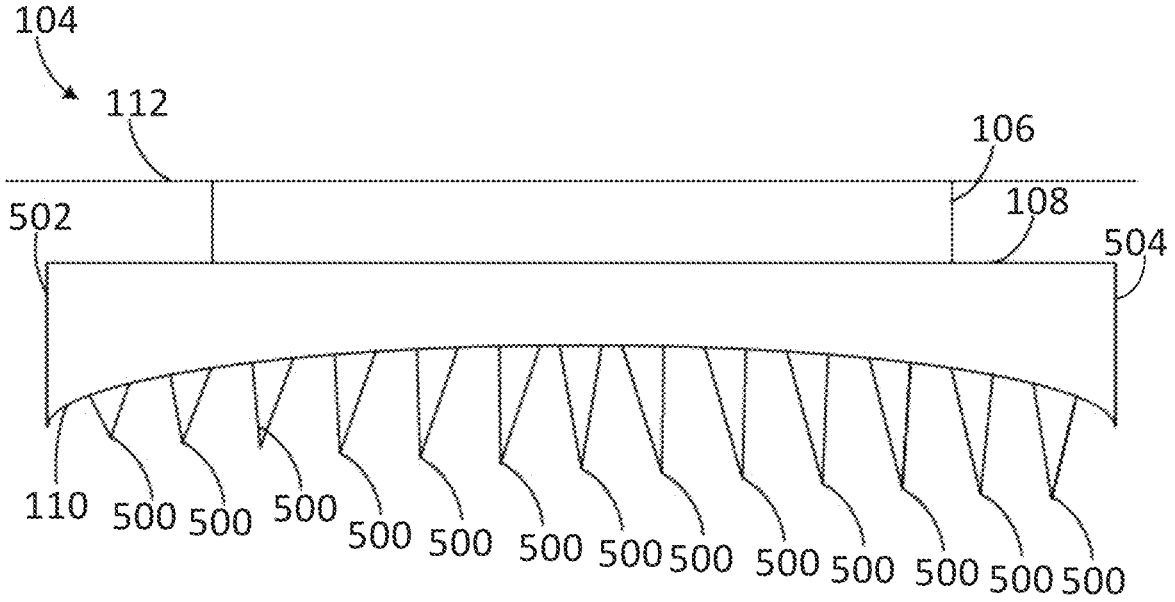
FIG. 5D is yet another side view of a panel assembly for use in a shower system, such as the shower system shown in FIG. 1, according to an exemplary embodiment of the present disclosure.

As shown in FIG. 5A, the panel assembly 104 includes a plurality of deflection features 500 that are each an elongated projection that extends across the deflection surface 110. Each of the deflection features 500 is parallel to the leading edge 502. The deflection features 500 may be of various shapes, sizes, and configurations. As shown in FIGS. 5B and 5C, the deflection features 500 are all the same shape and all have the same size relative to the deflection surface 110. In FIG. 5B, the deflection features 500 are evenly spaced along the deflection surface 110. In FIG. 5C, the deflection features 500 are least concentrated near the leading edge 502 and gradually more concentrated away from the leading edge 502 and towards a second edge (e.g., face, side, etc.) of the deflection surface 110, shown as a trailing edge 504, which may also be a textured surface. In other applications, the deflection features 500 are most concentrated near the leading edge 502 and gradually less concentrated away from the leading edge 502 and towards the trailing edge 504. As shown in FIG. 5D, the deflection features 500 gradually increase in size (e.g., height, etc.) from the leading edge 502 to the trailing edge 504. In other applications, the deflection features 500 gradually decrease in size from the leading edge 502 to the trailing edge 504.

Figure 6A:
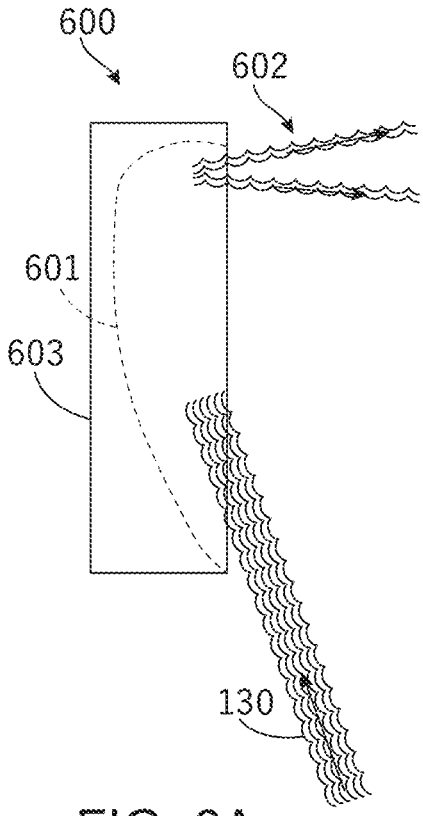
FIG. 6A is a cross-sectional view of a deflection feature for use in a deflection surface of a panel assembly, such as the panel assembly shown in FIG. 1, according to an exemplary embodiment of the present disclosure.

As shown in FIG. 6A, a cross-sectional view of one of the deflection features 500 according to an example embodiment. A body, shown as a first spray director 600, includes a cavity, shown as a first cavity 601. The first cavity 601 is shaped to accept a flow of water, such as the narrow stream 130, and reflect it as a spray, shown as a first directed spray 602. The first directed spray 602 exits the first cavity 601 at generally a right angle from a bottom surface of the first spray director, shown as a first bottom surface 603. The first bottom surface 603 is generally parallel to the panel assembly 104. In some embodiments, the first bottom surface 603 is coupled to the deflection surface 110. The deflection surface 110 may include a matrix of the first spray directors 600 disposed on the surface in a grid or other pattern, examples of which may correspond to FIGS. 7, 8A, 8B, and 9A-9E. In some embodiments, the first spray director 600 is integrated into the deflection surface 110. In some embodiments, a matrix of first cavities 601 are manufactured into the deflection surface 110 by means such as vacuum molding or stamping.

Figure 6B:
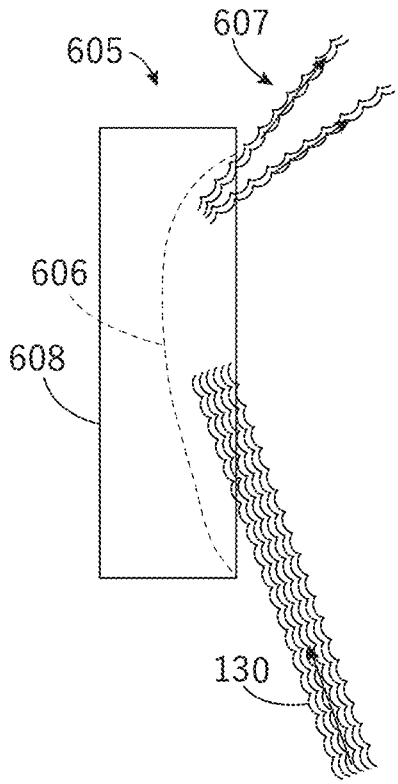
FIG. 6B is a cross-sectional view of a deflection feature for use in a deflection surface of a panel assembly, such as the panel assembly shown in FIG. 1, according to an exemplary embodiment of the present disclosure.

As shown in FIG. 6B, a cross-sectional view of one of the deflection features 500 according to an example embodiment. A body, shown as a second spray director 605, includes a cavity, shown as a second cavity 606. The second cavity 606 is shaped to accept a flow of water, such as the narrow stream 130, and reflect it as a spray, shown as a second directed spray 607. The second directed spray 607 exits the second cavity 606 in a direction generally away from the shower head assembly 102. The second spray director 605 also includes a surface, shown as a second bottom surface 608. The second bottom surface 608 is generally parallel to the panel assembly 104. In some embodiments, the second bottom surface 608 is coupled to the deflection surface 110. The deflection surface 110 may include a matrix of the second spray directors 605 disposed on the deflection surface 110 in a grid or other pattern, examples of which may correspond to FIGS. 7, 8A, 8B, and 9A-9E. In some embodiments, the second spray director 605 is integrated into the deflection surface 110. In some embodiments, a matrix of second cavities 606 are manufactured into the deflection surface 110 by means such as vacuum molding or stamping.

Figure 6C:
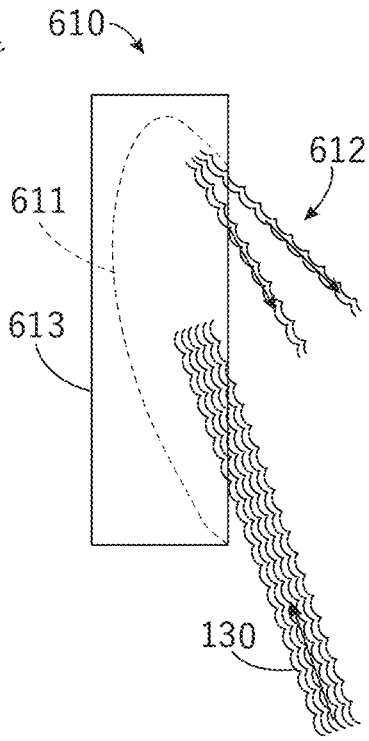
FIG. 6C is a cross-sectional view of a deflection feature for use in a deflection surface of a panel assembly, such as the panel assembly shown in FIG. 1, according to an exemplary embodiment of the present disclosure.

As shown in FIG. 6C, a cross-sectional view of one of the deflection features 500 according to an example embodiment. A body, shown as a third spray director 610, includes a cavity, shown as a third cavity 611. The third cavity 611 is shaped to accept a flow of water, such as the narrow stream 130, and reflect it as a spray, shown as a third directed spray 612. The third directed spray 612 exits the third cavity 611 in a direction generally toward the shower head assembly 102. The third spray director 610 also includes a surface, shown as a third bottom surface 613. The third bottom surface 613 is generally parallel to the panel assembly 104. In some embodiments, the third bottom surface 613 is coupled to the deflection surface 110. The deflection surface 110 may include a matrix of the third spray directors 610 disposed on the deflection surface 110 in a grid or other pattern, examples of which may correspond to FIGS. 7, 8A, 8B, and 9A-9E. In some embodiments, the third spray director 610 is integrated into the deflection surface 110. In some embodiments, a matrix of third cavities 611 are manufactured into the deflection surface 110 by means such as vacuum molding or stamping.

Figure 6D:
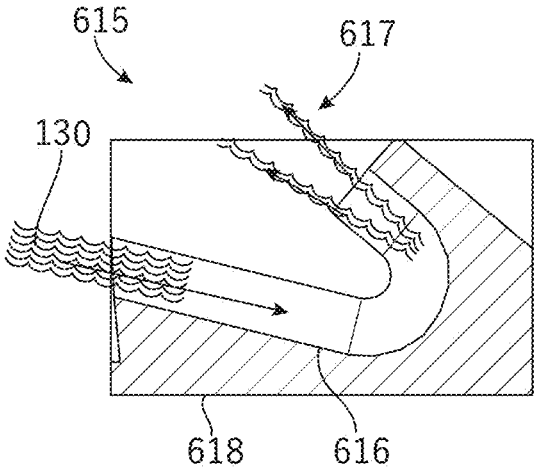
FIG. 6D is a cross-sectional view of a deflection feature for use in a deflection surface of a panel assembly, such as the panel assembly shown in FIG. 1, according to an exemplary embodiment of the present disclosure.
Figure 6E:
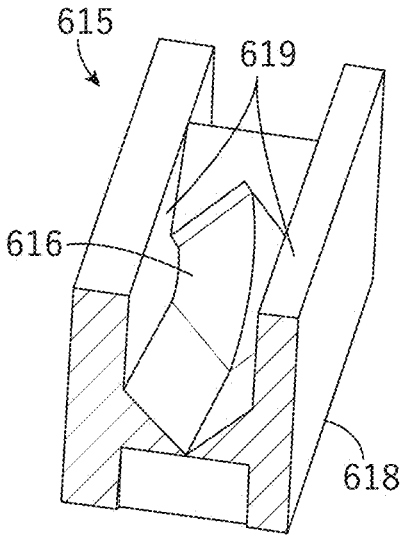
FIG. 6E is a perspective view of the deflection feature of FIG. 6D, according to an exemplary embodiment of the present disclosure.

As shown in FIG. 6D, a cross-sectional view of one of the deflection features 500 according to an example embodiment. A body, shown as a fourth spray director 615, includes a cavity, shown as a fourth cavity 616. The fourth cavity 616 is shaped to accept a flow of water, such as the narrow stream 130, and reflect it as a spray, shown as a fourth directed spray 617. The fourth directed spray 617 exits the fourth cavity 616 in a direction generally toward the shower head assembly 102. The fourth spray director 615 also includes a surface, shown as a fourth bottom surface 618. The fourth bottom surface 618 is generally parallel to the panel assembly 104. In some embodiments, the fourth bottom surface 618 is coupled to the deflection surface 110. The deflection surface 110 may include a matrix of the fourth spray directors 615 disposed on the deflection surface 110 in a grid or other pattern, examples of which may correspond to FIGS. 7, 8A, 8B, and 9A-9E. In some embodiments, the fourth spray director 615 is integrated into the deflection surface 110. In some embodiments, a matrix of fourth cavities 616 is manufactured into the deflection surface 110 by means such as vacuum molding or stamping. Referring to FIG. 6E, a perspective view of the fourth spray director 615 is shower, where sidewalls 619 cooperate to help define the fourth cavity 616.

Figure 6F:
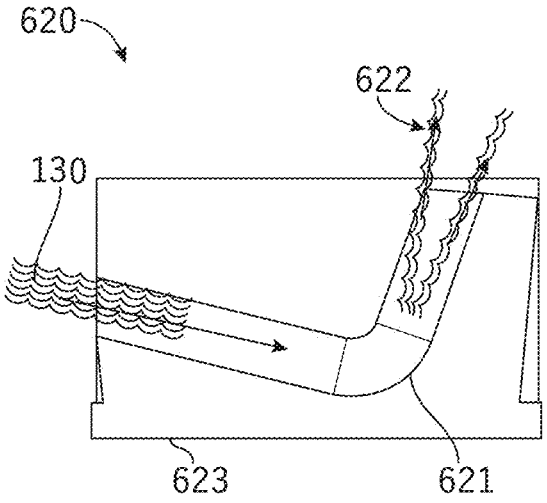
FIG. 6F is a cross-sectional view of a deflection feature for use in a deflection surface of a panel assembly, such as the panel assembly shown in FIG. 1, according to an exemplary embodiment of the present disclosure.
Figure 6G:
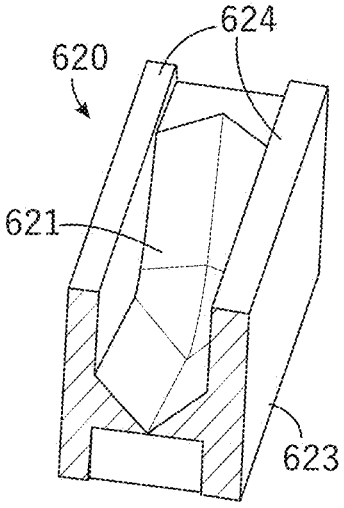
FIG. 6G is a perspective view of the deflection feature of FIG. 6F, according to an exemplary embodiment of the present disclosure.

As shown in FIG. 6F, a cross-sectional view of one of the deflection features 500 according to an example embodiment. A body, shown as a fifth spray director 620, includes a cavity, shown as a fifth cavity 621. The fifth cavity 621 is shaped to accept a flow of water, such as the narrow stream 130, and reflect it as a spray, shown as a fifth directed spray 622. The fifth directed spray 622 exits the fifth cavity 621 in a direction generally away from the shower head assembly 102. The fifth spray director 620 also includes a surface, shown as a fifth bottom surface 623. The fifth bottom surface 623 is generally parallel to the panel assembly 104. In some embodiments, the fifth bottom surface 623 is coupled to the deflection surface 110. The deflection surface 110 may include a matrix of the fifth spray directors 620 disposed on the deflection surface 110 in a grid or other pattern, examples of which may correspond to FIGS. 7, 8A, 8B, and 9A-9E. In some embodiments, the fifth spray director 620 is integrated into the deflection surface 110. In some embodiments, a matrix of fifth cavities 621 is manufactured into the deflection surface 110 by means such as vacuum molding or stamping. Referring to FIG. 6E, a perspective view of the fifth spray director 620 is shown, where sidewalls 624 help define the fifth cavity 621.

Figure 6H:
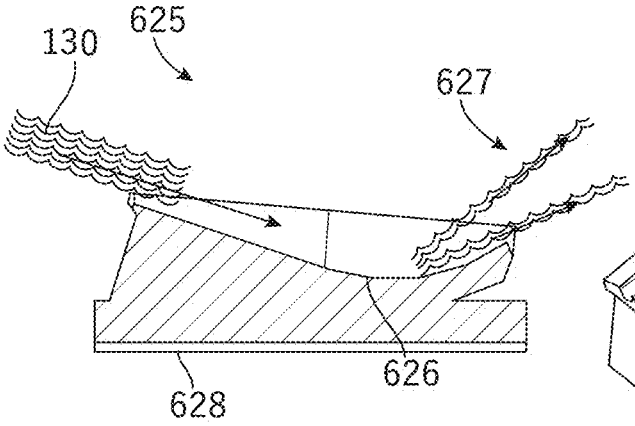
FIG. 6H is a cross-sectional view of a deflection feature for use in a deflection surface of a panel assembly, such as the panel assembly shown in FIG. 1, according to an exemplary embodiment of the present disclosure.
Figure 6J:
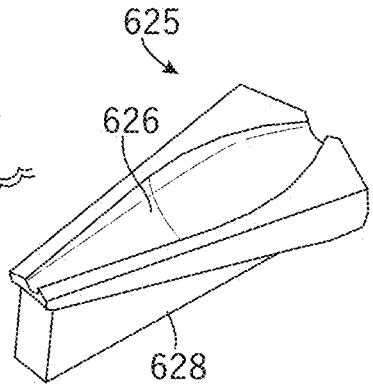
FIG. 6J is a perspective view of the deflection feature of FIG. 6H, according to an exemplary embodiment of the present disclosure.

As shown in FIG. 6H, a cross-sectional view of one of the deflection features 500 according to an example embodiment. A body, shown as a sixth spray director 625, includes a cavity, shown as a sixth cavity 626. The sixth cavity 626 is shaped to accept a flow of water, such as the narrow stream 130, and reflect it as a spray, shown as a sixth directed spray 627. The sixth directed spray 627 exits the sixth cavity 626 in a direction generally away from the shower head assembly 102. The sixth spray director 625 also includes a surface, shown as a sixth bottom surface 628. The sixth bottom surface 628 is generally parallel to the panel assembly 104. In some embodiments, the sixth bottom surface 628 is coupled to the deflection surface 110. The deflection surface 110 may include a matrix of the sixth spray directors 625 disposed on the deflection surface 110 in a grid or other pattern, examples of which may correspond to FIGS. 7, 8A, 8B, and 9A-9E. In some embodiments, the sixth spray director 625 is integrated into the deflection surface 110. In some embodiments, a matrix of sixth cavities 626 is manufactured into the deflection surface 110 by means such as vacuum molding or stamping. Referring to FIG. 6J, a perspective view of the sixth spray director 625 is shown.

Figure 6K:
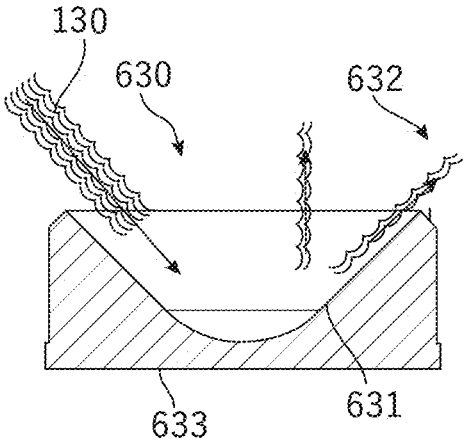
FIG. 6K is a cross-sectional view of a deflection feature for use in a deflection surface of a panel assembly, such as the panel assembly shown in FIG. 1, according to an exemplary embodiment of the present disclosure.
Figure 6L:
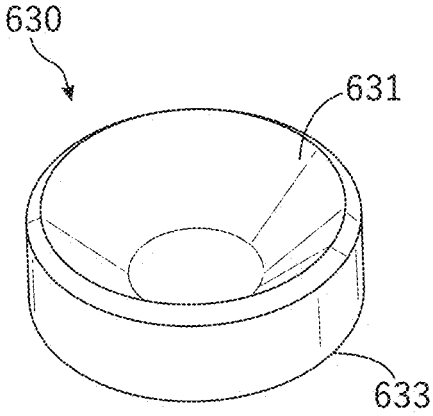
FIG. 6L is a perspective view of the deflection feature of FIG. 6K, according to an exemplary embodiment of the present disclosure.

As shown in FIG. 6K, a cross-sectional view of one of the deflection features 500 according to an example embodiment. A body, shown as a seventh spray director 630, includes a cavity, shown as a seventh cavity 631. The seventh cavity 631 is shaped to accept a flow of water, such as the narrow stream 130, and reflect it as a spray, shown as a seventh directed spray 632. The seventh directed spray 632 exits the seventh cavity 631 in a direction generally away from the shower head assembly 102. The seventh spray director 630 also includes a surface, shown as a seventh bottom surface 633. The seventh bottom surface 633 is generally parallel to the panel assembly 104. In some embodiments, the seventh bottom surface 633 is coupled to the deflection surface 110. The deflection surface 110 may include a matrix of the seventh spray directors 630 disposed on the deflection surface 110 in a grid or other pattern, examples of which may correspond to FIGS. 7, 8A, 8B, and 9A-9E. In some embodiments, the seventh spray director 630 is integrated into the deflection surface 110. In some embodiments, a matrix of seventh cavities 631 is manufactured into the deflection surface 110 by means such as vacuum molding or stamping. Referring to FIG. 6L, a perspective view of the seventh spray director 630 is shown.

Figure 6M:
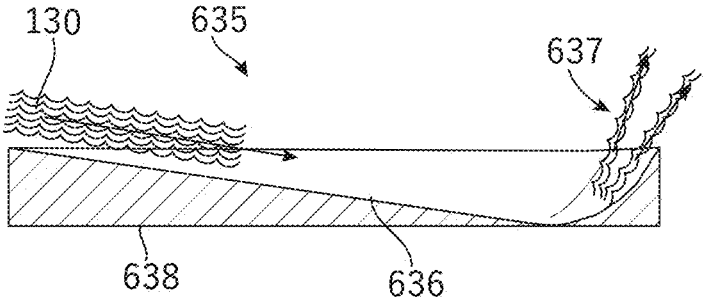
FIG. 6M is a cross-sectional view of a deflection feature for use in a deflection surface of a panel assembly, such as the panel assembly shown in FIG. 1, according to an exemplary embodiment of the present disclosure.
Figure 6N:
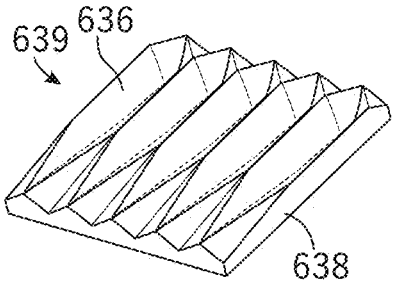
FIG. 6N is a perspective view of a matrix of the deflection feature of FIG. 6M, according to an exemplary embodiment of the present disclosure.
Figure 6O:
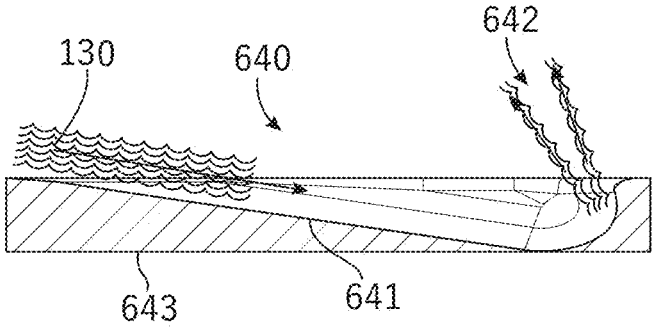
FIG. 6O is a cross-sectional view of a deflection feature for use in a deflection surface of a panel assembly, such as the panel assembly shown in FIG. 1, according to an exemplary embodiment of the present disclosure.

As shown in FIG. 6M, a cross-sectional view of one of the deflection features 500 according to an example embodiment. A body, shown as an eighth spray director 635, includes a cavity, shown as an eighth cavity 636. The eighth cavity 636 is shaped to accept a flow of water, such as the narrow stream 130, and reflect it as a spray, shown as an eighth directed spray 637. The eighth directed spray 637 exits the eighth cavity 636 in a direction generally away from the shower head assembly 102. The eighth spray director 635 also includes a surface, shown as an eighth bottom surface 638. The eighth bottom surface 638 is generally parallel to the panel assembly 104. In some embodiments, the eighth bottom surface 638 is coupled to the deflection surface 110. The deflection surface 110 may include a matrix of the eighth spray directors 635 disposed on the deflection surface 110 in a grid or other pattern, examples of which may correspond to FIGS. 7, 8A, 8B, and 9A-9E. In some embodiments, the eighth spray director 635 is integrated into the deflection surface 110. In some embodiments, a matrix of eighth cavities 636 is manufactured into the deflection surface 110 by means such as vacuum molding or stamping. Referring to FIG. 6N, a perspective view of a matrix 639 of the eighth cavities 636 is shown, where the matrix 639 includes five of the eighth cavities 636. In some embodiments, the matrix 639 includes more than five of the eighth cavities 636. The matrix 639 may be a single, contiguous body manufactured by means such as vacuum molding or stamping.

Figure 6P:
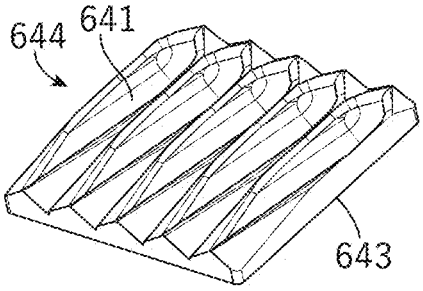
FIG. 6P is a perspective view of a matrix of the deflection feature of FIG. 6O, according to an exemplary embodiment of the present disclosure.

As shown in FIG. 5O, a cross-sectional view of one of the deflection features 500 according to an example embodiment. A body, shown as a ninth spray director 640, includes a cavity, shown as a ninth cavity 641. The ninth cavity 641 is shaped to accept a flow of water, such as the narrow stream 130, and reflect it as a spray, shown as a ninth directed spray 642. The ninth directed spray 642 exits the ninth cavity 641 in a direction generally toward the shower head assembly 102. The ninth spray director 640 also includes a surface, shown as a ninth bottom surface 643. The ninth bottom surface 643 is generally parallel to the panel assembly 104. In some embodiments, the ninth bottom surface 643 is coupled to the deflection surface 110. The deflection surface 110 may include a matrix of the ninth spray directors 640 disposed on the deflection surface 110 in a grid or other pattern, examples of which may correspond to FIGS. 7, 8A, 8B, and 9A-9E. In some embodiments, the ninth spray director 640 is integrated into the deflection surface 110. In some embodiments, a matrix of ninth cavities 641 is manufactured into the deflection surface 110 by means such as vacuum molding or stamping. Referring to FIG. 6P, a perspective view of a matrix 644 of the ninth cavities 641 is shown, where the matrix 644 includes five of the ninth cavities 641. In some embodiments, the matrix 644 includes more than five of the ninth cavities 641. The matrix 644 may be a single, contiguous body manufactured by means such as vacuum molding or stamping.

Figure 6Q:
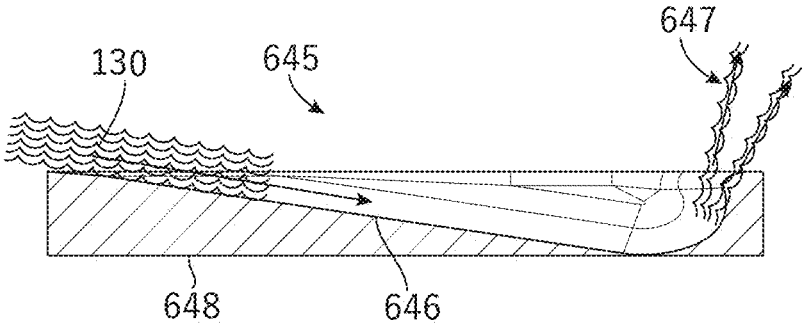
FIG. 6Q is a cross-sectional view of a deflection feature for use in a deflection surface of a panel assembly, such as the panel assembly shown in FIG. 1, according to an exemplary embodiment of the present disclosure.
Figure 6R:
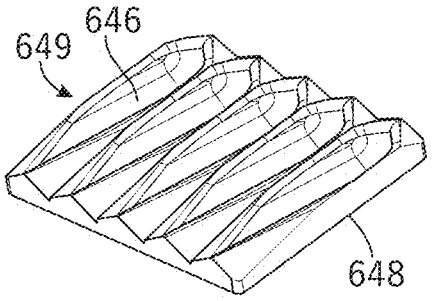
FIG. 6R is a perspective view of a matrix of the deflection feature of FIG. 6Q, according to an exemplary embodiment of the present disclosure.

As shown in FIG. 6Q, a cross-sectional view of one of the deflection features 500 according to an example embodiment. A body, shown as a tenth spray director 645, includes a cavity, shown as a tenth cavity 646. The tenth cavity 646 is shaped to accept a flow of water, such as the narrow stream 130, and reflect it as a spray, shown as a tenth directed spray 647. The tenth directed spray 647 exits the tenth cavity 646 in a direction generally away from the shower head assembly 102. The tenth spray director 645 also includes a surface, shown as a tenth bottom surface 648. The tenth bottom surface 648 is generally parallel to the panel assembly 104. In some embodiments, the tenth bottom surface 648 is coupled to the deflection surface 110. The deflection surface 110 may include a matrix of the tenth spray directors 645 disposed on the deflection surface 110 in a grid or other pattern, examples of which may correspond to FIGS. 7, 8A, 8B, and 9A-9E. In some embodiments, the tenth spray director 645 is integrated into the deflection surface 110. In some embodiments, a matrix of tenth cavities 646 are manufactured into the deflection surface 110 by means such as vacuum molding or stamping. Referring to FIG. 6R, a perspective view of a matrix 649 of the tenth cavities 646 is shown, where the matrix 649 includes five of the tenth cavities 646. In some embodiments, the matrix 649 includes more than five of the tenth cavities 646. The matrix 649 may be a single, contiguous body manufactured by means such as vacuum molding or stamping.

Figure 7:
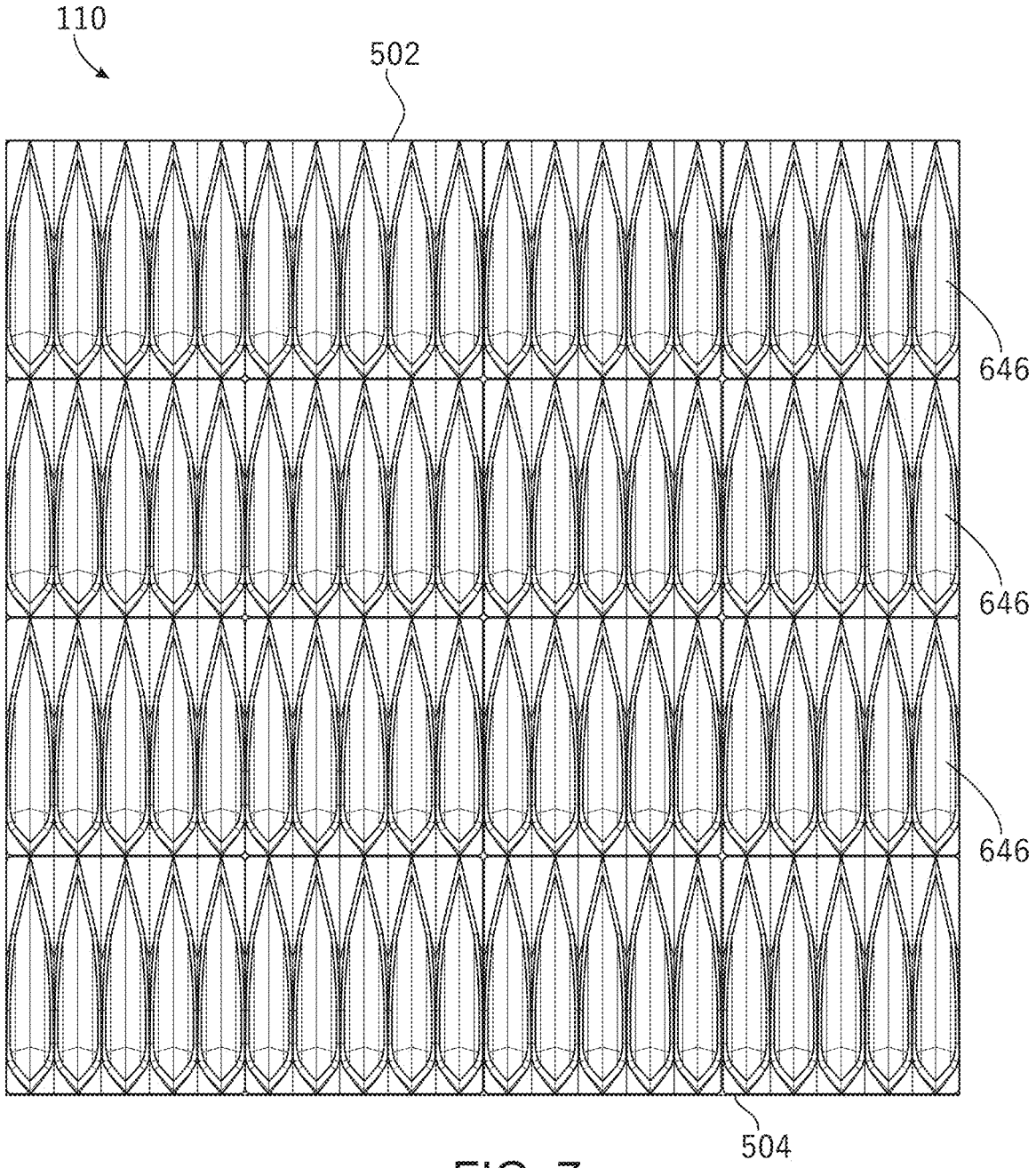
FIG. 7 is a front view of a deflection surface, such as the deflection surface shown in FIG. 1, according to an exemplary embodiment of the present disclosure.

Referring to FIG. 7, the deflection surface 110 according to an example embodiment. The deflection surface 110 is shown as a matrix of the tenth cavities 646. In some embodiments, the deflection surface 110 is created from a combination of any of the first cavities 601, second cavities 606, third cavities 611, fourth cavities 616, fifth cavities 621, sixth cavities 626, seventh cavities 631, eighth cavities 636, ninth cavities 641, or tenth cavities 646 (herein called "deflection cavities"). The deflection cavities may be structurally integrated into the deflection surface 110 through manufacturing means, including but not limited to casting, vacuum molding, 3D printing, forging, stamping, or milling. The deflection surface 110 is shown by way of example as manufactured such that the leading edge 502 is contiguous and such that the trailing edge 504 is contiguous.

In some embodiments, the deflection surface 110 is made from a matrix of any combination of the first spray director 600, the second spray director 605, the third spray director 610, the fourth spray director 615, the fifth spray director 620, the sixth spray director 625, the seventh spray director 630, the eighth spray director 635, the ninth spray director 640, or the tenth spray director 645 (herein called the "spray directors"). The spray directors may be coupled together in any combination to create the deflection surface 110. In some embodiments, the deflection surface 110 is not rectangular. In some embodiments, the deflection surface 110 is shaped like a triangle, circle, heart, star, oval, ellipse, crescent, or other planar shape. In some embodiments, the deflection surface 110 takes a three-dimensional shape, such as a hemisphere, cone, cylinder, ellipsoid, spheroid, sphere, hyperboloid, paraboloid, or torus, etc.

In some embodiments, the deflection surface 110 has dimensions of 2 ft-by-2 ft, such that the deflection surface 110 is able to be coupled to the wall 113 using a standard construction adhesive, such as that used for tiling walls. In some embodiments, the dimensions of the deflection surface 110 are less than 2 ft-by-2 ft. In some embodiments, the dimensions of the deflection surface 110 are greater than 2 ft-by-2 ft and distributed to the end-user in a roll. In some embodiments, the deflection surface 110 is manufactured from a flexible material, such as silicon, such that the deflection surface can be rolled and/or coupled to an irregular (e.g., not flat, curved, uneven, etc.) wall.

In some embodiments, the deflection surface 110, including the deflections cavities and spray directors disposed hereon, may be coated (e.g., treated, etc.) with a coating. For example, the deflection surface 110 may be treated with a hydrophobic coating. In other examples, the deflection surface 110 may be treated such that the deflection surface 110 provides relatively high surface tension.

Figure 8A:
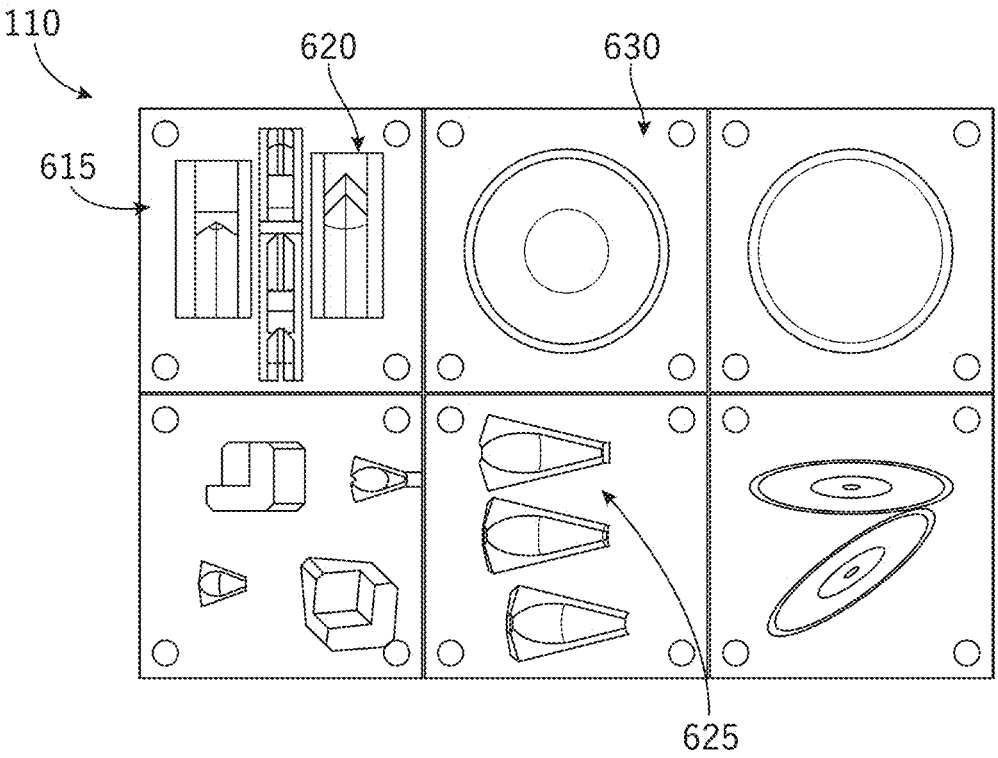
FIG. 8A is a front view of a deflection surface, such as the deflection surface shown in FIG. 1, according to an exemplary embodiment of the present disclosure.
Figure 8B:
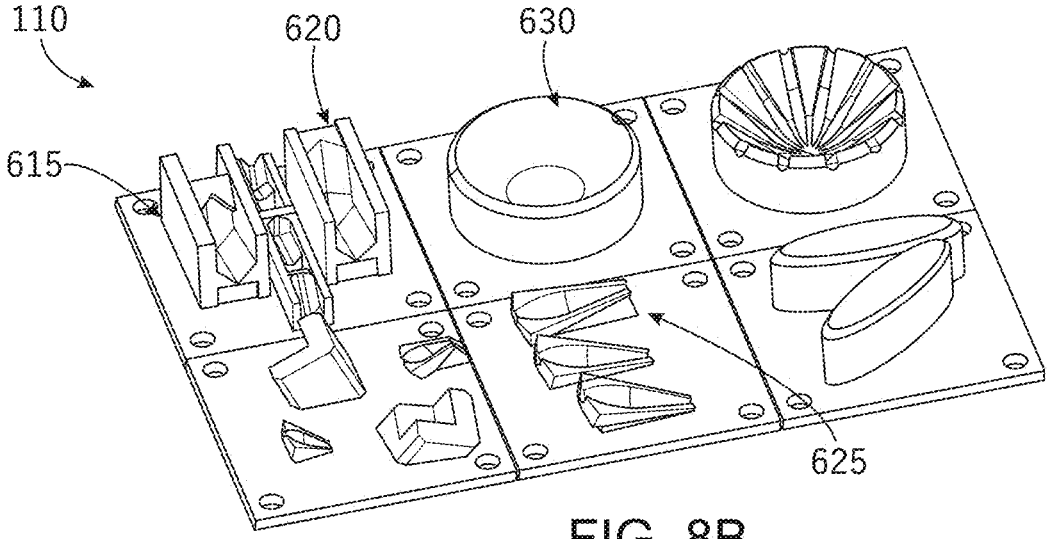
FIG. 8B is a perspective view of the deflection surface of FIG. 8A, according to an exemplary embodiment of the present disclosure.

Referring to FIG. 8A, the deflection surface 110 is shown according to an example embodiment. The deflection surface 110 is a contiguous body, which includes, structurally integrated within, the fourth spray director 615, the fifth spray director 620, the sixth spray director 625, and the seventh spray director 630. The deflection surface 110 may include any combination of the spray directors in any orientation on the deflection surface 110. The deflection surface 110 may be independent from the panel assembly 104. The deflection surface 110 is shown as an example embodiment and is not meant to be limiting. As one of ordinary skill in the art can appreciate, there are infinite combinations and orientations of disposing the spray directors in the deflection surface 110, and that is before considering embodiments where the deflection surface 110 is not a planar surface. Referring to FIG. 8B, a perspective view of the deflection surface 110. In some embodiments, the deflection surface 110, including the spray directors 615, 620, 625, 630 disposed hereon and may be coated (e.g., treated, etc.) with a coating. For example, the deflection surface 110 may be treated with a hydrophobic coating. In other examples, the deflection surface 110 may be treated such that the deflection surface 110 provides relatively high surface tension.

Figure 9A:
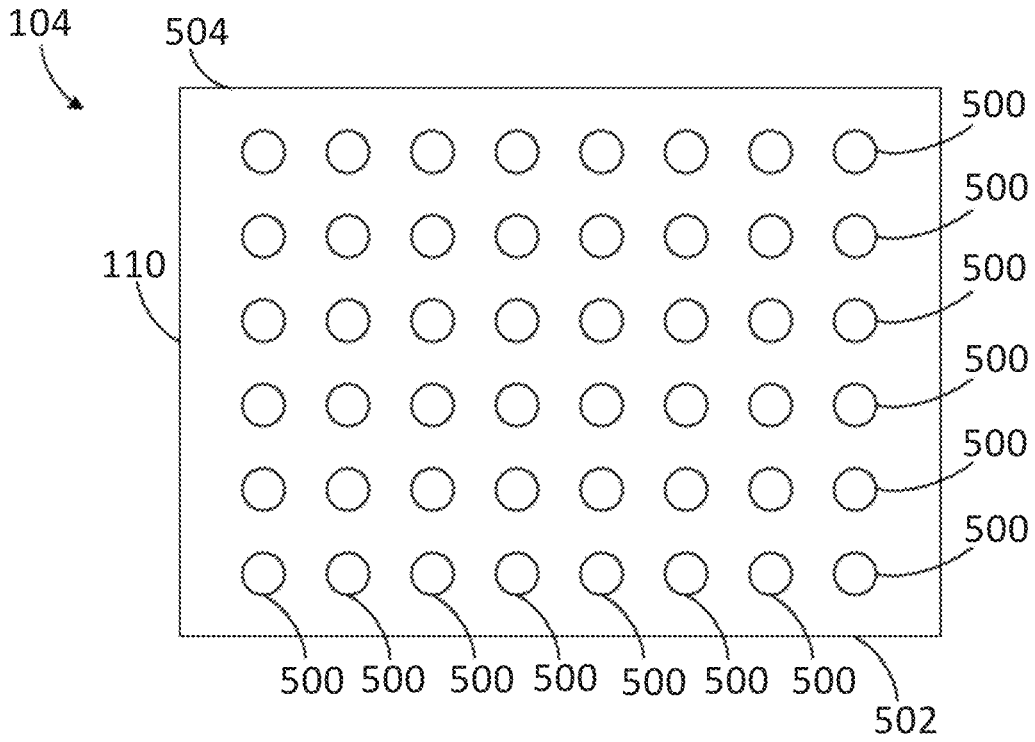
FIG. 9A is another bottom view of a panel assembly for use in a shower system, such as the shower system shown in FIG. 1, according to an exemplary embodiment of the present disclosure.
Figure 9B:
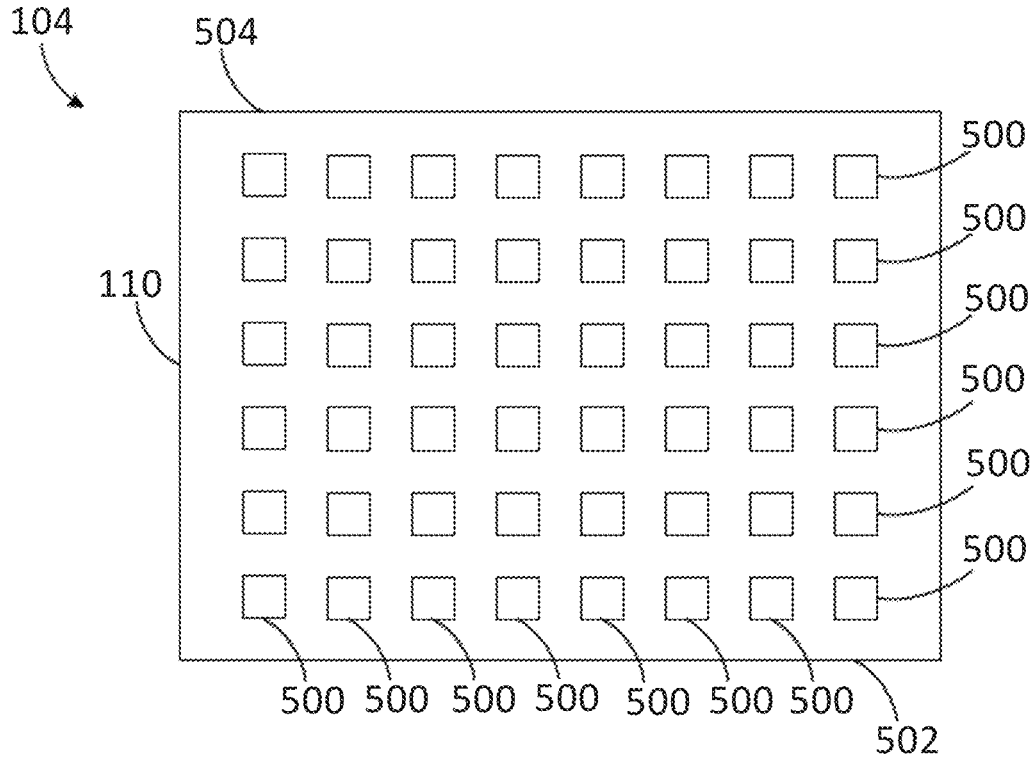
FIG. 9B is yet another bottom view of a panel assembly for use in a shower system, such as the shower system shown in FIG. 1, according to an exemplary embodiment of the present disclosure.
Figure 9C:
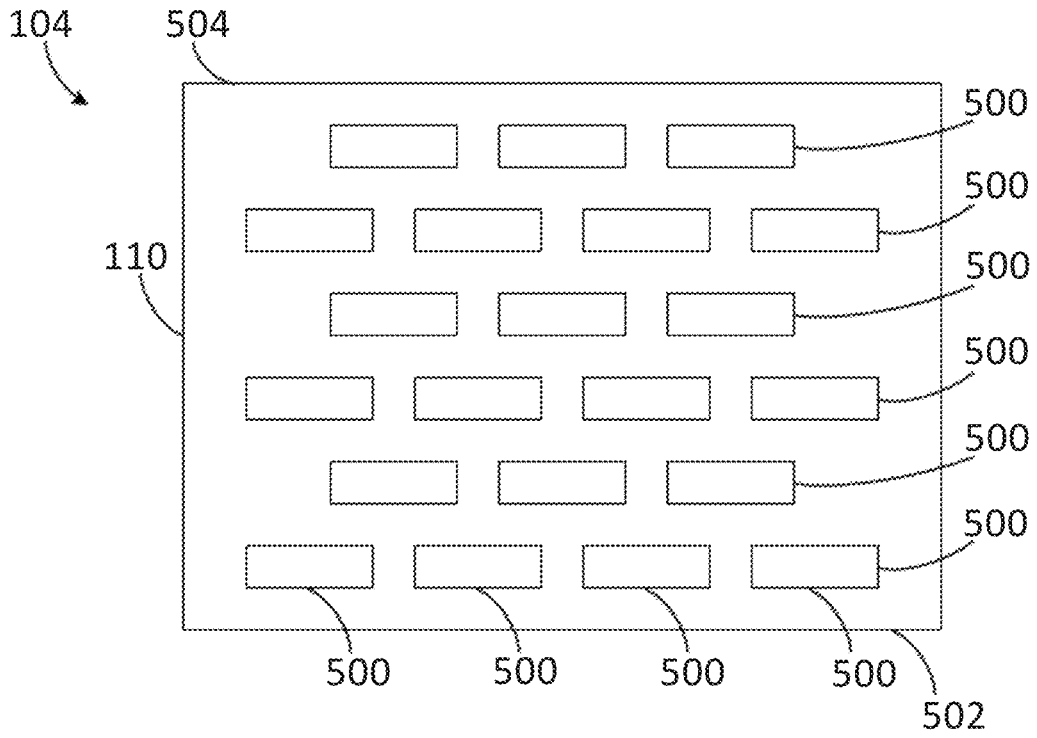
FIG. 9C is yet another bottom view of a panel assembly for use in a shower system, such as the shower system shown in FIG. 1, according to an exemplary embodiment of the present disclosure.
Figure 9D:
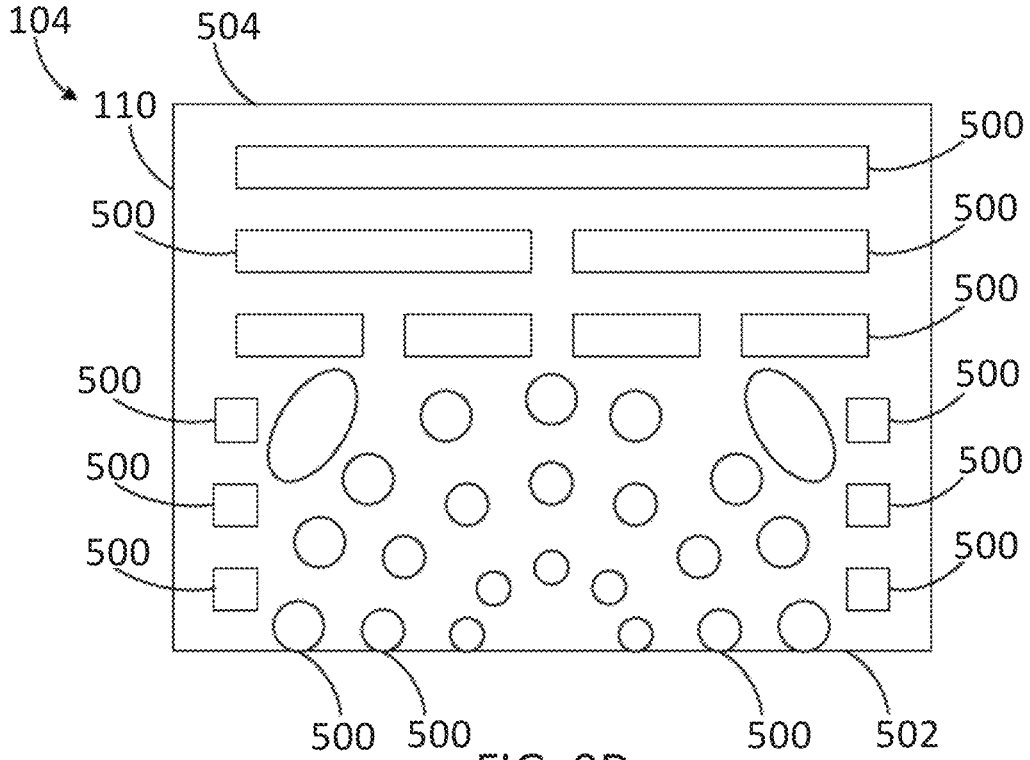
FIG. 9D is yet another bottom view of a panel assembly for use in a shower system, such as the shower system shown in FIG. 1, according to an exemplary embodiment of the present disclosure.
Figure 9E:
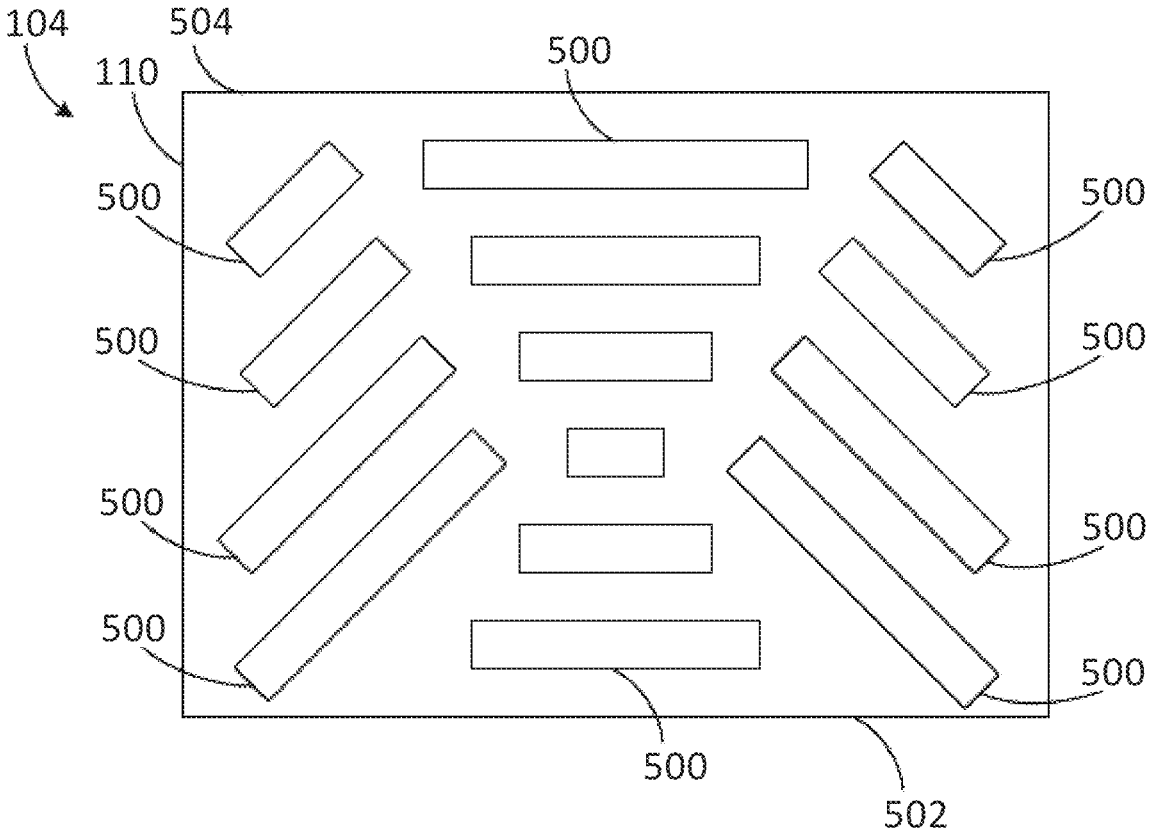
FIG. 9E is yet another bottom view of a panel assembly for use in a shower system, such as the shower system shown in FIG. 1, according to an exemplary embodiment of the present disclosure.

In some applications, as shown in FIGS. 9A-9E, the deflection features 500 may resemble posts (e.g., pegs, pins, etc.). For example, the deflection features 500 may resemble circular pegs, as shown in FIG. 9A and square or rectangular pegs, as shown in FIG. 9B. In some applications, the deflection features 500 may be offset relative to other deflection features 500, as shown in FIG. 9C. As shown in FIG. 9D, different shapes and sizes of the deflection features 500 may be incorporated within the panel assembly 104. The deflection features 500 may also be angled relative to the leading edge 502 and/or the trailing edge 504. As shown in FIG. 9E, the deflection features 500 may be angled towards each other to funnel water towards other deflection features 500.

In some embodiments, the deflection surface 110, including the deflection features 500, is coated (e.g., treated, etc.) with a coating. For example, the deflection surface 110 is treated with a hydrophobic coating. In other examples, the deflection surface 110 may be treated such that the deflection surface 110 provides relatively high surface tension.

As shown in FIG. 1, the infrared (IR) heater 122 (e.g., an IR sauna lamp, an IR bathroom heater, etc.) is positioned within the panel 108, disposed behind the deflection surface 110. In some embodiments, IR heater 122 is not included in the shower assembly. In some embodiments, the IR heater 122 is not included in the panel assembly 104. The use of infrared technology and the IR heater 122 is an optional feature to supplement the shower system 100. However, the shower system 100 can still function without the IR heater 122. In some embodiments, the IR heater 122 is located above the user and disposed within the panel 108 such that the IR heater 122 can warm the shower cell and the water In some embodiments, the IR heater 122 is disposed behind the panel assembly 104. The IR heater 122 can warm the shower cell 400 and the water that is reflected off of the panel assembly 104. Thus, the IR heater 122 may provide the user with a sauna-like experience, while the deflection surface 110 in the panel assembly 104 may cause a rainfall or side-spray effect for the water spraying onto the user. Furthermore, the IR heater 122 produces IR rays 124.

FIG. 1 further illustrates the IR rays 124 that the user receives from the IR heater 122 while showering. The effects from contact with IR rays 124 may provide the user with a number of health benefits related to IR exposure (e.g., increased blood circulation, pain relief from sore muscles, boost in metabolism, etc.), while also warming the space within the shower cell 400. The IR rays 124 from the IR heater 122 also heat the panel 108 and the deflection surface 110, which may maintain or increase the temperature of the water that comes in contact with the deflection surface 110. However, according to one embodiment, the shower itself and the shower head assembly 102 maintain primary control of the temperature of water.

The infrared heater 122 and panel assembly 104 can be part of a shower system such as disclosed in U.S. patent application Ser. No. 16/182,377, filed Nov. 6, 2018, the complete disclosure of which is hereby incorporated by reference in its entirety. Reference to this shower system is only intended to provide an exemplary system integrating the infrared heating panel disclosed herein and should not be regarded as limiting.

Figure 10:
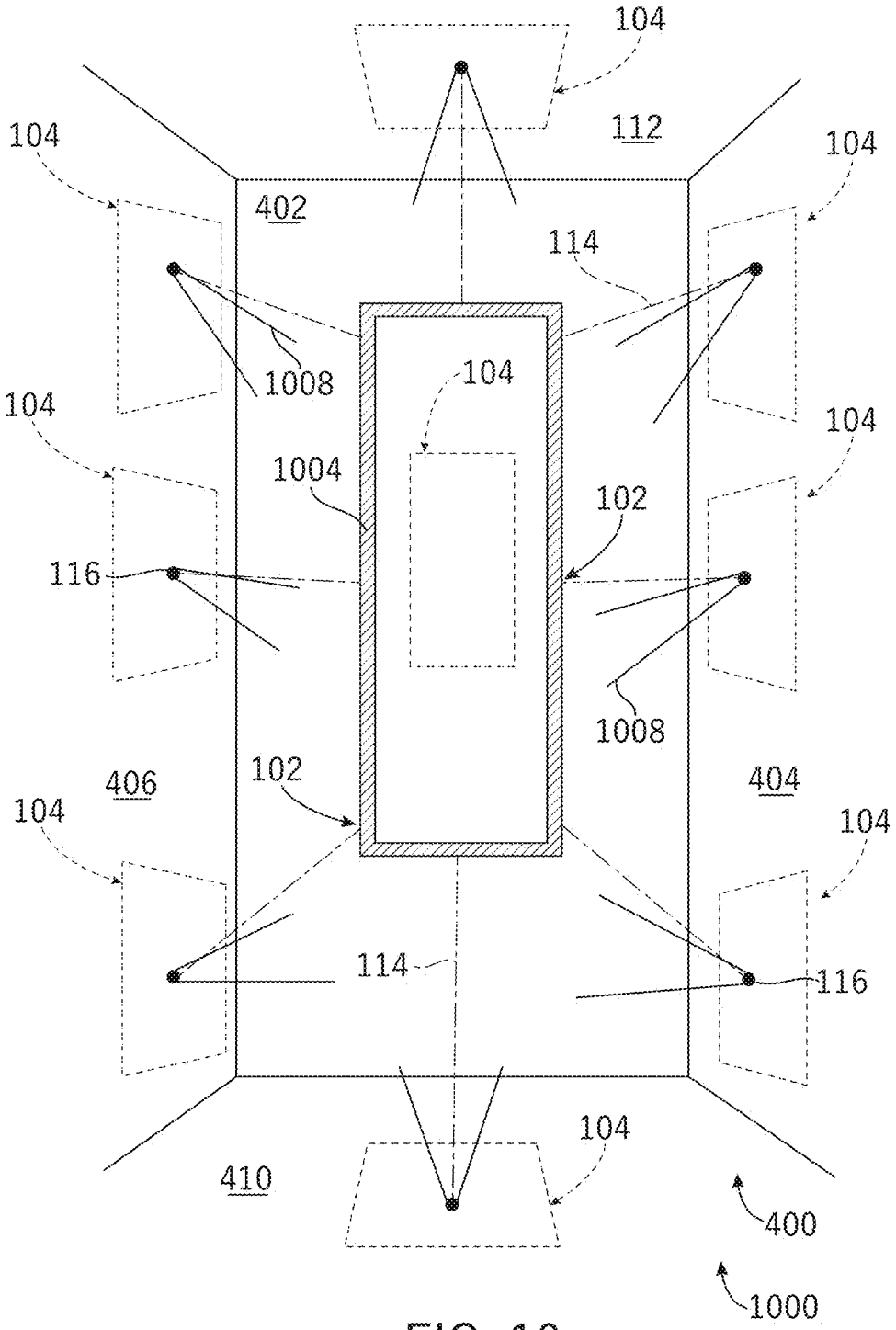
FIG. 10 is a front view of a shower system according to an exemplary embodiment of the present disclosure.

Referring to FIG. 10, a shower system 1000 is shown according to an exemplary embodiment. The shower system 1000 includes a shower cell, such as a shower cell 400. Mounted (e.g., coupled, etc.) to the front wall 402 is a body, shown as a shower head mount 1004. The shower head mount 1004 is configured to support a plurality of the shower head assemblies 102. The shower head mount 1004 is configured to hide the shower head assemblies 102 from view of the user. In an exemplary embodiment, the shower head mount 1004 supports eight of the shower head assemblies 102. The shower head assemblies 102 are configured to spray the narrow stream 130 along the trajectory 114 at one of the front wall 402, the right wall 404, the left wall 406, the back wall 408 (not shown), the floor 410, or the ceiling 112. The shower head assembly 102 is configured to aim at the target 116 on any one of the walls of the shower cell 400, in some embodiments hitting the target 116 with the narrow stream 130. Once the shower head assembly 102 hits the target 116, the narrow stream 130 is reflected by the deflection surface 110 coupled to one of the walls without the panel assembly 104.

In an exemplary embodiment, the panel assembly 104 is coupled to the right wall 404. The target 116 is located on the panel assembly 104. The shower head assembly 102 sprays the narrow stream 130 at the target 116 such that the deflection surface 110 of the panel assembly 104 reflects the spray back into the center of the shower cell 400. When the narrow stream 130 is reflected, it is reflected as a spray, shown as a dispersed spray 1008. The dispersed spray 1008 is wider (e.g., has a diameter greater than the diameter 132, covers more area, etc.) than the narrow stream 130. The deflection surface 110 on the panel assembly 104 is configured to reflect the narrow stream 130 in such a way that it breaks up the narrow stream 130 and makes it more comfortable for the user to shower in. In some embodiments, the deflection surface 110 does not break up the spray and reflects the narrow stream 130 as the narrow stream 130 (e.g., a spray having the diameter 132). In some embodiments, the front wall 402, the right wall 404, the left wall 406, the back wall 408 (not shown), and the ceiling 112 are completely covered in the panel assembly 104 such that each deflection surface 110 of each panel assembly 104 is contiguous. In some embodiments, the panel assembly 104 does not include the IR heater 122. As such, the deflection surface 110 may be coupled directly to the shower cell 400, much like tiling. The shower cell 400 may be tiled with the deflection surface 110 such that the walls are completely covered and do not show between each deflection surface 110.

In some embodiments, the shower head assembly 102 is controlled by a digital diverter such that the shower head assembly 102 is configured to be shut off (e.g., prevented a flow of water, etc.). The digital diverter may be configured to control each of the shower head assemblies 102 coupled to the shower head mount 1004. If the user prefers, the user may select, via user interface, which of the shower head assemblies 102 should be turned on and which of the shower head assemblies 102 should be turned off. For example, the user may decide to only turn on the shower head assembly 102 configured to spray the narrow stream 130 at the ceiling 112 such that water is only falling on the user from above. The user may decide to only spray water from the sides, for example if the user would prefer to keep the user's hair dry. Thus, the user would select to only turn on the shower head assemblies 102 directed at the right wall 404 and the left wall 406 via the user interface. The digital diverter will then block a flow of water from reaching the shower head assemblies 102 directed at any of the floor 410, the ceiling 112, the front wall 402, or the back wall 408. The digital diverter will allow a flow of water to the shower head assemblies 102 directed at the right wall 404 and the left wall 406.

Figure 11:
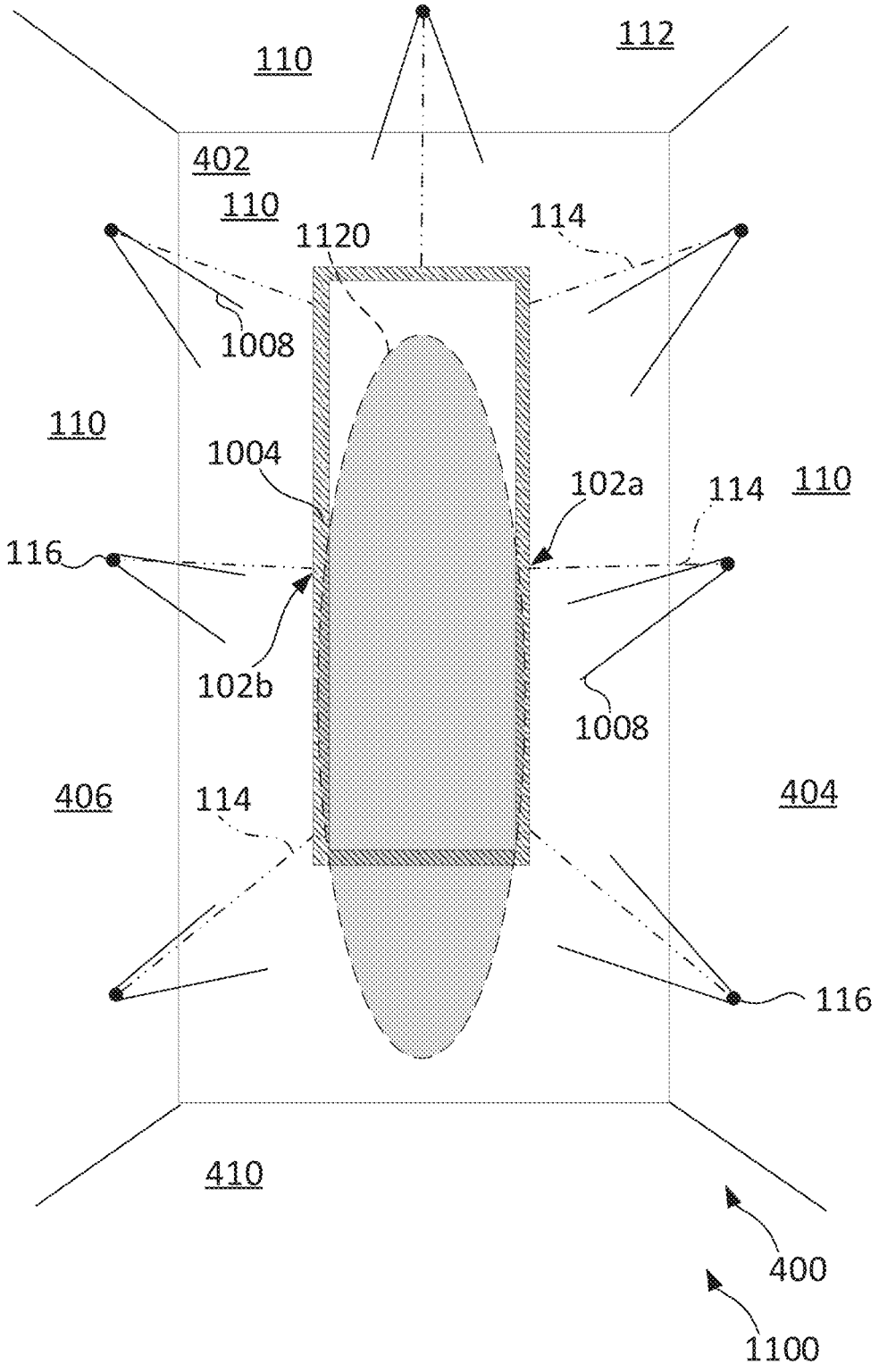
FIG. 11 is a front view of a shower system according to an exemplary embodiment of the present disclosure.

Referring to FIG. 11, a shower system 1100. The shower system 1100 includes the shower cell 400. Each of the walls of the shower cell 400 are shown by way of example as completely covered by the deflection surface 110 such that the walls cannot be seen from within the shower cell 400. The deflection surface 110 is configured to reflect the narrow stream 130 toward a target, shown as a target 1120. In an exemplary embodiment, the target 1120 is displaced from the front wall 402 by about 1-3 feet. The deflection surface 110 is configured to reflect the narrow stream 130 toward the target 1120 no matter at which of the walls the narrow stream 130 is directed. For example, if the narrow stream 130 is directed at the right wall 404 and behind the target 1120 (e.g., the narrow stream 130 is directed toward the target 116, the target 116 nearer the back wall 408 than the target 1120), the deflection surface 110 would reflect the narrow stream 130 such that the target 1120 would be sprayed by water from behind (i.e., in a direction generally from the back wall 408 and toward the front wall 402).

The shower system 1100 includes a first shower head assembly 102*a* and a second shower head assembly 102*b*. The first shower head assembly 102*a* is coupled to a backside of the shower head mount 1004 nearer the right wall 404 than the left wall 406. In some embodiments, the first shower head assembly 102*a* is coupled proximate the shower head mount 1004 such that the first shower head assembly 102*a* is hidden from view from within the shower cell 400. The second shower head assembly 102*b* is similar to the first shower head assembly 102*a*. One difference is that the second shower head assembly 102*b* is coupled to a backside of the shower head mount 1004 neared the left wall 406 than to the right wall 404. The first shower head assembly 102*a* is configured to be controlled by a first actuator, the first actuator configured to direct the first shower head assembly 102*a* to spray the narrow stream 130 along the trajectory 114 such that the narrow stream 130 hits the right wall 404. The right wall 404 includes the deflection surface 110, the deflection surface 110 configured to receive the narrow stream 130 from the first shower head assembly 102*a* and reflect the narrow stream 130 toward the target 1120. The first actuator may direct the first shower head assembly 102*a* to spray the narrow stream 130 at any part of the right wall 404, and the deflection surface 110 coupled to the right wall 404 is configured to accept the narrow stream 130 and reflect the narrow stream 130 at the target 1120.

The second shower head assembly 102*b* is configured to be controlled by a second actuator, the second actuator configured to direct the second shower head assembly 102*b* to spray the narrow stream 130 along the trajectory 114 such that the narrow stream 130 hits the left wall 406. The left wall 406 includes the deflection surface 110, the deflection surface 110 configured to receive the narrow stream 130 from the first shower head assembly 102*a* and reflect the narrow stream 130 toward the target 1120. The second actuator may direct the first shower head assembly 102*b* to spray the narrow stream 130 at any part of the left wall 406, and the deflection surface 110 coupled to the left wall 406 is configured to accept the narrow stream 130 and reflect the narrow stream 130 at the target 1120.

In some embodiments, the first shower head assembly 102*a* and the second shower head assembly 102*b* are controlled by a digital diverter. The digital diverter is operatively coupled to the first shower head assembly 102*a* and the second shower head assembly 102*b* such that the digital diverter may block a flow of water to the first shower head assembly 102*a* while allowing a flow of water to the second shower head assembly 102*b*, and vice versa. The digital diverter may use solenoid valves to selectively stop a flow of water from reaching the first shower head assembly 102*a*, the second shower head assembly 102*b*, or both at the same time.

The first actuator and the second actuator may be controlled by a processor such that the first shower head assembly 102*a* and the second shower head assembly 102*b* are directed anywhere within the shower cell 400. The first actuator may change the direction of the first shower head assembly 102*a* while the first shower head assembly 102*a* is spraying water. The first actuator may change the direction of the first shower head assembly 102*a* to spray the narrow stream 130 anywhere within the shower cell 400. The first actuator may control the first shower head assembly 102*a* to alternate spraying the narrow stream 130 between a first location in the shower cell 400 and a second location in the shower cell 400. No matter where in the shower cell 400 the first shower head assembly 102*a* sprays the narrow stream 130, the deflection surface 110 reflects the narrow stream 130 toward the target 1120. The second actuator is similar to the first actuator in that the second actuator has similar control over the second shower head assembly 102*b* as does the first actuator have control over the first shower head assembly 102*a*.

As utilized herein, the terms "approximately," "about," "parallel," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. It is understood that the term "parallel" is intended to encompass de minimis variations as would be understood to be within the scope of the disclosure by those of ordinary skill in the art.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The terms "coupled," "connected," and the like, as used herein, mean the joining of two members directly or indirectly to one another. Such joining may be stationary (e.g., permanent) or movable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments and that such variations are intended to be encompassed by the present disclosure.

The construction and arrangement of the shower system 100, the shower head assembly 102, the panel assembly 104, the infrared heater 122, and all other elements and assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Other substitutions, modifications, changes, and omissions may also be made in the design, operating conditions, and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

What is claimed is:

1. A panel assembly for use in a shower, the panel assembly comprising:

a body configured to be coupled to a surface within the shower;

a panel coupled to the body opposite the surface;

a deflection surface disposed on the panel opposite the body; and an infrared heater disposed within the panel and proximate to the deflection surface, the infrared heater configured to heat the deflection surface and produce infrared rays.

2. The panel assembly of claim 1, wherein the deflection surface further comprises deflection features, the deflection features configured to reflect a spray of water toward a target.

3. The panel assembly of claim 2, wherein the deflection features are structurally integrated into the deflection surface.

4. The panel assembly of claim 2, wherein the deflection features are coupled to the deflection surface.

5. The panel assembly of claim 2 further comprising a first spray director disposed on the deflection surface, the first spray director configured to accept a stream of water and reflect the stream of water at a first angle.

6. The panel assembly of claim 5 further comprising a second spray director disposed on the deflection surface, the second spray director configured to accept the stream of water and reflect the stream of water at a second angle.

7. The panel assembly of claim 6, wherein the first spray director and the second spray director are structurally integrated with the panel.

8. A shower system comprising:

a first shower head; and a panel assembly comprising:

a body configured to be coupled to a support surface of the shower system;

a panel coupled to the body opposite the support surface;

a deflection surface disposed on the panel opposite the body; and an infrared heater disposed within the panel and proximate the deflection surface, the infrared heater configured to heat the deflection surface and produce infrared rays;

wherein the first shower head is configured to provide a first stream of water along a trajectory to the panel assembly.

9. The shower system of claim 8, further comprising:

a first deflection feature disposed on the deflection surface and configured to receive the first stream and reflect the first stream at a first trajectory; and a second deflection feature disposed on the deflection surface and configured to receive the first stream and reflect the first stream as a second trajectory;

wherein both the first deflection feature and the second deflection feature are structurally integral to the deflection surface.

10. The shower system of claim 9, further comprising an actuator operatively coupled to the first shower head, wherein the actuator is configured to alternate directing the first shower head toward the first deflection feature and directing the first shower head toward the second deflection feature.

11. The shower system of claim 9, further comprising a second shower head configured to provide a second stream of water to the second deflection feature.

12. A shower system comprising:

a first shower head; and a shower cell comprising:

a left deflection surface coupled to a left wall; and a right deflection surface coupled to a right wall;

wherein the first shower head is controlled by a first actuator to spray a first stream along a first trajectory at any of the left deflection surface and the right deflection surface.

13. The shower system of claim 12, further comprising a front deflection surface coupled to a front wall, the first shower head controlled by the first actuator to spray the first stream along the first trajectory to any of the left deflection surface, the right deflection surface, and the front deflection surface.

14. The shower system of claim 13, further comprising a top deflection surface coupled to a front wall, the first shower head controlled by the first actuator to spray the first stream along the first trajectory to any of the left deflection surface, the right deflection surface, the front deflection surface, and the top deflection surface.

15. The shower system of claim 14, further comprising a second shower head, the second shower head controlled by a second actuator to spray a second stream along a second trajectory at any of the left deflection surface, the right deflection surface, the front deflection surface, and the top deflection surface.

16. The shower system of claim 15, further comprising:

a left deflector structurally integrated with the left deflection surface and configured to receive any of the first stream or the second stream;

a right deflector structurally integrated with the right deflection surface and configured to receive any of the first stream or the second stream;

a front deflector structurally integrated with the front deflection surface and configured to receive any of the first stream or the second stream; and a top deflector structurally integrated with the top deflection surface and configured to receive any of the first stream or the second stream;

wherein each of the left deflector, the right deflector, the front deflector, and the top deflector are configured to reflect both the first stream and the second stream toward a target within the shower cell.

17. The shower system of claim 15, further comprising a shower head mount coupled to the front wall, the first shower head, and the second shower head.

18. The shower system of claim 12, further comprising:

a first infrared heater interposed between the left deflection surface and the left wall, the first infrared heater configured to heat the left deflection surface and produce infrared rays; and a second infrared heater interposed between the right deflection surface and the right wall, the second infrared heater configured to heat the right deflection surface and produce infrared rays.

* * * * *